US007226143B2

(12) United States Patent
Mitsuzawa

(10) Patent No.: US 7,226,143 B2
(45) Date of Patent: Jun. 5, 2007

(54) PRINTING APPARATUS

(75) Inventor: Toyohiko Mitsuzawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 207 days.

(21) Appl. No.: 10/682,778

(22) Filed: Oct. 10, 2003

(65) Prior Publication Data

US 2004/0130586 A1 Jul. 8, 2004

(30) Foreign Application Priority Data

Oct. 11, 2002 (JP) ..... 2002-299491
Oct. 11, 2002 (JP) ..... 2002-299492

(51) Int. Cl.
*B41J 29/393* (2006.01)

(52) U.S. Cl. ..... 347/15; 347/17; 347/19

(58) Field of Classification Search ..... 347/15, 347/17, 19, 40, 16; 358/1.2, 1.9
See application file for complete search history.

(56) References Cited

U.S. PATENT DOCUMENTS 5,581,284 A * 12/1996 Hermanson ..... 347/43
6,293,648 B1 * 9/2001 Anderson ..... 347/29
6,353,485 B1 * 3/2002 Kaneko ..... 358/1.2
6,616,267 B2 * 9/2003 Weijkamp ..... 347/43
6,644,774 B1 * 11/2003 Burger et al. ..... 347/19
2003/0137698 A1 * 7/2003 Pritchard ..... 358/3.06
2005/0083365 A1 * 4/2005 Numata et al. ..... 347/19

FOREIGN PATENT DOCUMENTS

JP 2000-158735 6/2000

* cited by examiner

*Primary Examiner*—Lamson Nguyen
(74) *Attorney, Agent, or Firm*—Sughrue Mion, PLLC

(57) ABSTRACT

A printing apparatus includes at least two print head groups, each print head group having at least one print head for printing on a printing medium by ejecting ink, the print head being movable; and at least two image processing sections, each image processing section being provided for each of the print head groups, the image processing section being capable of processing an image to be printed on the printing medium using the print head that belongs to the print head group corresponding to that image processing section.

2 Claims, 11 Drawing Sheets

PRINTING APPARATUS

CROSS-REFERENCE TO RELATED APPLICATIONS

The present application claims priority upon Japanese Patent Application No. 2002-299491 filed Oct. 11, 2002 and Japanese Patent Application No. 2002-299492 filed Oct. 11, 2002, which are herein incorporated by reference.

BACKGROUND OF THE INVENTION

1. Field of the Invention

The present invention relates to printing apparatuses. More specifically, the present invention relates to printing apparatuses having an image processing section for processing images and a plurality of movable print heads, wherein an image that has been processed by the image processing section is printed on a medium to be printed by ejecting ink from the print heads.

2. Description of the Related Art

In recent years, color inkjet printers of the type that ejects multi-colored ink from print heads and forms ink dots on print paper have become popular as output devices for computers. Furthermore, recently, comparatively large color inkjet printers have been realized, that use a plurality of print heads to print on print paper, such as roll paper (see, for example, JP 2000-158735A). Such color inkjet printers are provided with an image processing section for processing images, and a plurality of movable print heads, and they eject ink from the print heads to print an image that has been processed with the image processing section onto a paper to be printed.

(1) The above-described color inkjet printers having a plurality of print heads can be expected to have a higher customizability, due to having a plurality of print heads, than color inkjet printers having only a single print head. For example, there is the possibility to realize an easy customization, such as allowing printing with only the other print heads when some of the print heads cannot be used as a result of a defect or the like, or grouping the plurality of print heads into at least two print head groups and printing a plurality of independent images with the print head groups.

However, even though there are a plurality of print heads, since there is only one image processing section for processing the images to be printed with the print heads, there are difficulties in the easy realization of the above-described customization.

(2) The above-described color inkjet printer may be provided with a temperature detector. For example the ejection of ink with the print heads or a cleaning quantity of the print heads may be controlled in accordance with the output of this temperature detector.

Moreover, in the above-described color inkjet printers having a plurality of print heads, there is the possibility to realize an easy customization, such as allowing printing with only the other print heads when some of the print heads cannot be used due to a defect or the like, or grouping the plurality of print heads into at least two print head groups and printing a plurality of independent images with the print head groups. Thus, providing an image processing section for each of the at least two print head groups into which the plurality of print heads have been divided is an effective means for realizing a color inkjet printer with high customizability.

In this situation however, even though there are a plurality of print heads, if, as mentioned above, there is only one temperature detector, there are difficulties in the easy realization of the above-described customization.

SUMMARY OF THE INVENTION

In view of the above-noted problems, it is an object of the present invention to provide a printing apparatus with high customizability.

According to a main aspect of the present invention, a printing apparatus includes at least two print head groups, each print head group having at least one print head for printing on a printing medium by ejecting ink, the print head being movable; and at least two image processing sections, each image processing section being provided for each of the print head groups, the image processing section being capable of processing an image to be printed on the printing medium using the print head that belongs to the print head group corresponding to that image processing section.

According to another main aspect of the present invention, a printing apparatus includes at least two print head groups, each print head group having at least one print head for printing on a printing medium by ejecting ink, the print head being movable; and at least two image processing sections, each image processing section being provided for each of the print head groups, the image processing section being capable of processing an image to be printed on the printing medium using the print head that belongs to the print head group corresponding to that image processing section; and at least two temperature detectors, each temperature detector being provided for each of the print head groups.

Features of the present invention other than the above will become clearer through the accompanying drawings and the following description.

BRIEF DESCRIPTION OF THE DRAWINGS

In order to facilitate further understanding of the present invention and the advantages thereof, reference is now made to the following description taken in conjunction with the accompanying drawings wherein.

DETAILED DESCRIPTION OF THE INVENTION

Figure 1:
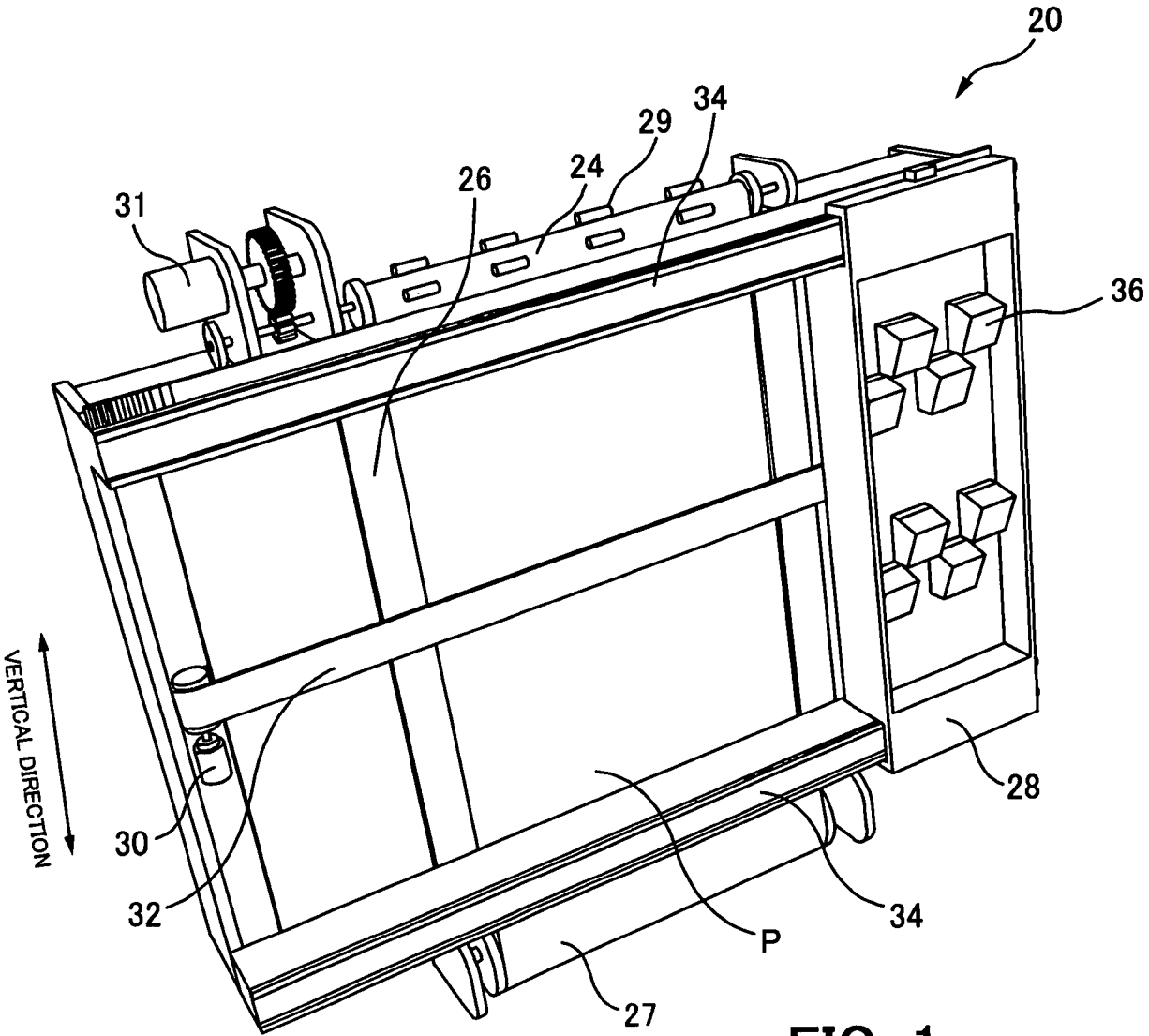
FIG. 1 is a perspective view schematically showing an example of a color inkjet printer 20 according to an embodiment of the present invention.

At least the following matters will be made clear by the description in the present specification and the accompanying drawings.

According to a main aspect of the present invention, a printing apparatus comprises:

at least two print head groups, each print head group having at least one print head for printing on a printing medium by ejecting ink, the print head being movable; and at least two image processing sections, each image processing section being provided for each of the print head groups, the image processing section being capable of processing an image to be printed on the printing medium using the print head that belongs to the print head group corresponding to that image processing section.

By providing an image processing section for each of the at least two print head groups into which the print heads have been grouped, it is possible to realize a printing apparatus with high customizability.

It is preferable that each of the print head groups forms a print head unit arranged in a unit, and each of the print head unit is attachable to and detachable from the printing apparatus.

With this configuration, it is possible to easily adjust the number of print head units that are used in accordance with the user's needs regarding printing, such as the size of the image to be printed or the printing speed, and the customizability becomes higher.

It is preferable that each of the image processing sections is arranged in a separate unit, and each of the image processing sections arranged in a unit is attachable to and detachable from the printing apparatus.

With this configuration, it is possible to easily adjust the number of image processing sections that are used in accordance with the user's needs regarding printing, such as the size of the image to be printed or the printing speed, and the customizability becomes higher.

It is preferable that the printing apparatus further includes at least two ink ejection control sections for controlling ejection of ink with the print heads, of the ink ejection control sections being provided for each of the print head groups.

With this configuration, a high customizability due to providing a plurality of print heads can be achieved efficiently.

It is preferable that each of the ink ejection control sections is arranged in a separate unit, and each of the ink ejection control sections arranged in a unit is attachable to and detachable from the printing apparatus.

With this configuration, it is possible to easily adjust the number of ink ejection control sections that are used in accordance with the user's needs regarding printing, such as the size of the image to be printed or the printing speed, and the customizability becomes higher.

It is preferable that each of the print head groups forms a print head unit arranged in a unit, and each of the print head unit has an ink accommodation section for accommodating ink that is supplied to the print head provided in each of the print head unit.

With this configuration, it is possible to easily adjust the number of ink accommodation sections that are used in accordance with the user's needs regarding printing, such as the size of the image to be printed or the printing speed, and the customizability becomes higher.

It is preferable that the printing apparatus further includes at least two cleaning sections for cleaning the print heads, each of the cleaning sections being provided for each of the print heads; wherein the cleaning sections form at least two cleaning units, each of the cleaning units being arranged in a unit for each of the print head groups, and each of the cleaning units is attachable to and detachable from the printing apparatus.

With this configuration, it is possible to easily adjust the number of cleaning units that are used in accordance with the user's needs regarding printing, such as the size of the image to be printed or the printing speed, and the customizability becomes higher.

It is preferable that each of the cleaning units includes a protection section for protecting the print heads.

With this configuration, it is possible to easily adjust the number of protection sections that are used in accordance with the user's needs regarding printing, such as the size of the image to be printed or the printing speed, and the customizability becomes higher.

It is preferable that each of the image processing sections processes an image; and each of the image, which has been processed by each of the image processing sections, is printed on the printing medium in the order in which the processing of each of the image with each of the image processing sections is finished by ejecting ink from the print head belonging to each of the print head groups corresponding to each of the image processing sections.

With this configuration, printing at higher speeds can be realized more effectively, using the above-described high customizability of the printing apparatus.

Moreover, a printing apparatus in accordance with the present invention includes at least two print head groups, each print head group having at least one print head for printing on a printing medium by ejecting ink, the print head being movable; and at least two image processing sections, each image processing section being provided for each of the print head groups, the image processing section being capable of processing an image to be printed on the printing medium using the print head that belongs to the print head group corresponding to that image processing section each of the print head groups forms a print head unit arranged in a unit;

each of the print head unit is attachable to and detachable from the printing apparatus;

each of the image processing sections is arranged in a separate unit;

each of the image processing sections arranged in a unit is attachable to and detachable from the printing apparatus;

the printing apparatus further comprises at least two ink ejection control sections for controlling ejection of ink with the print heads, each of the ink ejection control sections being provided for each of the print head groups;

each of the ink ejection control sections is arranged in a separate unit;

each of the ink ejection control sections arranged in a unit is attachable to and detachable from the printing apparatus;

each of the print head unit has an ink accommodation section for accommodating ink that is supplied to the print head provided in each of the print head unit;

the printing apparatus further comprises at least two cleaning sections for cleaning the print heads, each of the cleaning sections being provided for each of the print heads;

the cleaning sections form at least two cleaning units, each of the cleaning units being arranged in a unit for each of the print head groups, and each of the cleaning units is attachable to and detachable from the printing apparatus; and each of the cleaning units comprises a protection section for protecting the print heads; and each of the image processing sections processes an image; and each of the image, which has been processed by each of the image processing sections, is printed on the printing medium in the order in which the processing of each of the image with each of the image processing sections is finished by ejecting ink from the print head belonging to each of the print head groups corresponding to each of the image processing sections.

With this configuration, all of the previously mentioned effects are displayed, so that the object of the present invention is achieved most advantageously.

According to another main aspect of the present invention, a printing apparatus includes at least two print head groups, each print head group having at least one print head for printing on a printing medium by ejecting ink, the print head being movable; and at least two image processing sections, each image processing section being provided for each of the print head groups, the image processing section being capable of processing an image to be printed on the printing medium using the print head that belongs to the print head group corresponding to that image processing section; and at least two temperature detectors, each temperature detector being provided for each of the print head groups.

By providing an image processing section for each of the at least two print head groups into which the print heads have been grouped, and providing a temperature detector for each of the print head groups, a printing apparatus with high customizability can be realized.

It is preferable that each of the print head groups forms a print head unit arranged in a unit, and each of the print head unit includes each of the temperature detectors for detecting temperature inside that print head unit.

With this configuration, various kinds of controls can be properly carried out in accordance with the temperature inside the printing heads.

It is preferable that each of the image processing sections is arranged in a separate unit, and each of the image processing sections arranged in a unit is attachable to and detachable from the printing apparatus.

With this configuration, it is possible to easily adjust the number of image processing sections that are used in accordance with the user's needs regarding printing, such as the size of the image to be printed or the printing speed, and the customizability becomes higher.

It is preferable that the printing apparatus further includes, at least two ink ejection control sections for controlling ejection of ink with the print heads, each of the ink ejection control sections being provided for each of the print head groups.

With this configuration, a high customizability due to providing a plurality of print heads can be achieved efficiently.

It is preferable that each of the ink ejection control sections is arranged in a separate unit, and each of the ink ejection control sections arranged in a unit is attachable to and detachable from the printing apparatus.

With this configuration, it is possible to easily adjust the number of ink ejection control sections that are used in accordance with the user's needs regarding printing, such as the size of the image to be printed or the printing speed, and the customizability becomes higher.

It is preferable that in accordance with an output of each of the temperature detector, ejection of ink with the print head that belongs to the print head unit comprising each of the temperature detector is controlled with each of the ink ejection control section.

With this configuration, image formation of a high quality standard can be ensured.

It is preferable that, if the output from one of the temperature detectors exceeds a predetermined value, the ejection of ink with the print head that belongs to the print head unit comprising that temperature detector is stopped.

With this configuration, damage to components due to temperature increase can be properly prevented.

It is preferable that the temperature detectors are arranged in on the print heads.

With this configuration, the temperature of the print heads can be properly monitored.

It is preferable that the temperature detectors are arranged on a vertically upper side of the print head units.

With this configuration, it is possible to obtain a temperature output under the worst conditions.

It is preferable that the print head in which the ink ejection speed is high among all the print heads is arranged on a vertically upper side of the printing apparatus, and the print head in which the ink ejection speed is low among all the print heads is arranged on a vertically lower side of the printing apparatus.

With this configuration, image formation of a high quality standard can be ensured even better.

It is preferable that the printing apparatus further includes cleaning sections for cleaning the print heads, and at least one cleaning control section for controlling the cleaning sections, wherein a cleaning quantity of the print heads with the cleaning sections is controlled by the cleaning control section, in accordance with an output of the temperature detectors.

With this configuration, proper cleaning of the print heads in accordance with changes in temperature becomes possible.

It is preferable that each of the ink ejection control sections, which is arranged in a unit, includes a second temperature detector for detecting temperature inside that ink ejection control section.

With this configuration, various kinds of controls can be properly carried out in accordance with the temperature inside the ink ejection control sections.

It is preferable that the ejection of ink is controlled by the ink ejection control sections, in accordance with an output of the second temperature detectors.

Also in this case, the above-noted effect, that is, the effect of ensuring image formation of a high quality standard can be maintained.

It is preferable that the printing apparatus further includes cleaning sections for cleaning the print heads, and at least one cleaning control section for controlling the cleaning sections, wherein a cleaning quantity of the print heads with the cleaning sections is controlled cleaning control sections, in accordance with an output of the second temperature detectors.

Also in this case, the above-noted effect, that is, the effect of allowing proper cleaning of the print heads in accordance with changes in temperature can be maintained.

Moreover, a printing apparatus in accordance with the present invention includes at least two print head groups, each print head group having at least one print head for printing on a printing medium by ejecting ink, the print head being movable; and at least two image processing sections, each image processing section being provided for each of the print head groups, the image processing section being capable of processing an image to be printed on the printing medium using the print head that belongs to the print head group corresponding to that image processing section; and at least two temperature detectors, each temperature detector being provided for each of the print head groups;

each of the print head groups forms a print head unit arranged in a unit;

each of the print head unit comprises each of the temperature detectors for detecting temperature inside that print head unit;

each of the image processing sections is arranged in a separate unit;

each of the image processing sections arranged in a unit is attachable to and detachable from the printing apparatus;

the printing apparatus further comprises at least two ink ejection control sections for controlling ejection of ink with the print heads, each of the ink ejection control sections being provided for each of the print head groups;

each of the ink ejection control sections is arranged in a separate unit;

each of the ink ejection control sections arranged in a unit is attachable to and detachable from the printing apparatus;

in accordance with an output of each of the temperature detector, ejection of ink with the print head that belongs to the print head unit comprising each of the temperature detector is controlled with each of the ink ejection control section;

if the output from one of the temperature detectors exceeds a predetermined value, the ejection of ink with the print head that belongs to the print head unit comprising that temperature detector is stopped;

the temperature detectors are arranged in on the print heads;

the temperature detectors are arranged on a vertically upper side of the print head units;

the print head in which the ink ejection speed is high among all the print heads is arranged on a vertically upper side of the printing apparatus, and the print head in which the ink ejection speed is low among all the print heads is arranged on a vertically lower side of the printing apparatus; and the printing apparatus further comprises cleaning sections for cleaning the print heads, and at least one cleaning control section for controlling the cleaning sections, wherein a cleaning quantity of the print heads with the cleaning sections is controlled by the cleaning control sections, in accordance with an output of the temperature detectors.

With this configuration, almost all of the previously mentioned effects are displayed, so that the object of the present invention is achieved most advantageously.

Outline Example of Printing Apparatus

Figure 2:
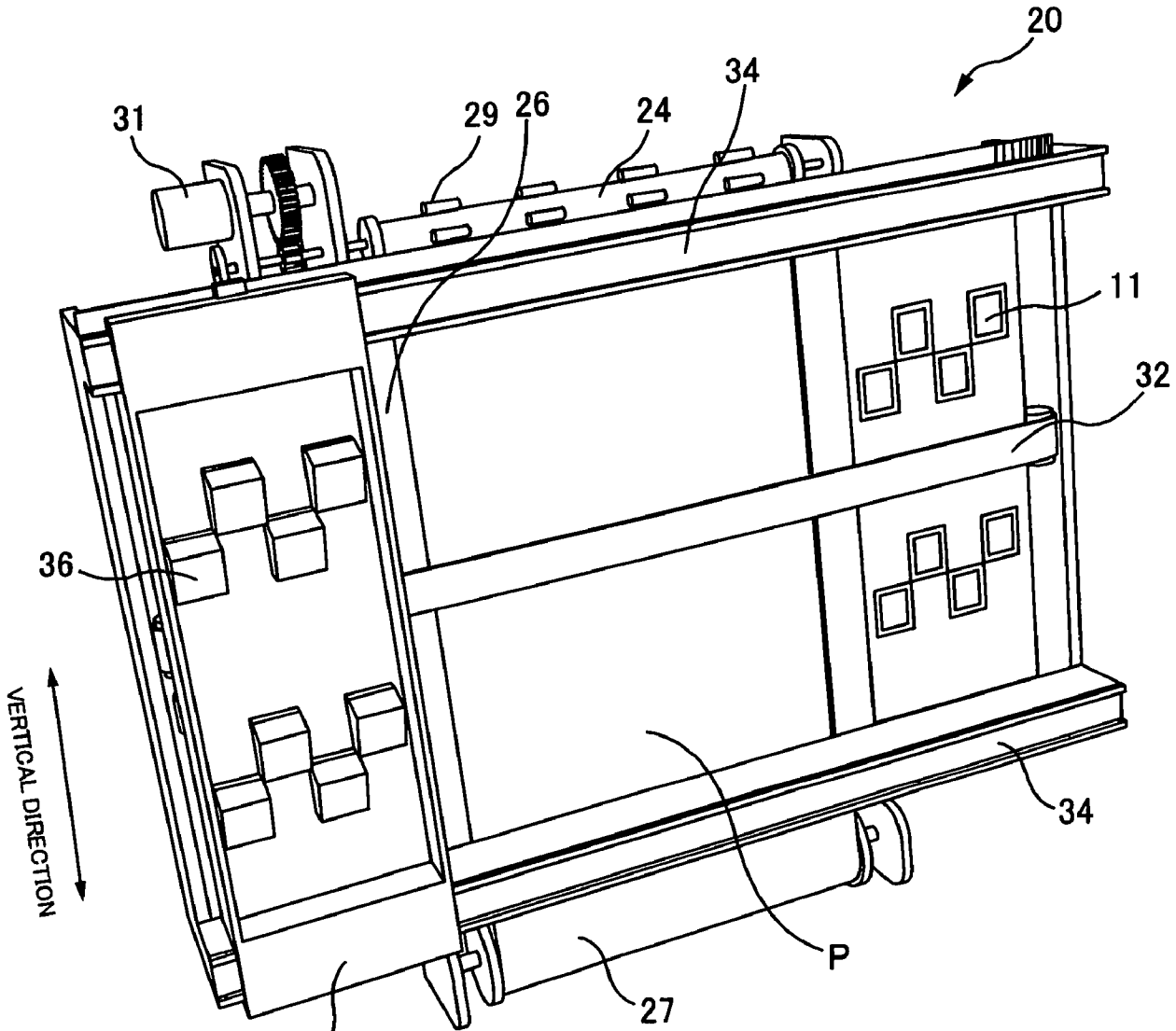
FIG. 2 is a perspective view schematically showing an example of a color inkjet printer 20 according to an embodiment of the present invention.

FIG. 1 and FIG. 2 are perspective views showing an outline of a color inkjet printer 20 as one example of a printing apparatus. This color inkjet printer 20 is adapted to relatively large print papers such as roll paper or the paper sheets of A0 size or B0 size of the JIS standard. In the examples of FIG. 1 and FIG. 2, this color printer 20 is provided with roll paper. It should be noted that in the color inkjet printer 20 shown in FIG. 1 and the color inkjet printer 20 shown in FIG. 2, the position of the carriage (described below) is different.

The color inkjet printers 20 shown in FIGS. 1 and 2 include a paper feed motor 31, a smap roller 24 that is driven by the paper feed motor 31 and feeds roll paper P serving as the medium to be printed in a paper-feed direction (also referred to as "sub-scanning direction" in the following), a roll paper holder 27 on which roll paper P can be set, paper-pressing rollers 29 for pressing down the roll paper P to the smap roller 24, a platen 26 that can support the roll paper P, print heads 36 provided with a multitude of nozzles, a carriage 28 that is provided with the print heads 36 and that can be moved in the main-scanning direction, a carriage motor 30, a pull belt 32 that is driven by the carriage motor 30 and that moves the carriage 28, and guide rails 34 for guiding the carriage 28.

The roll paper P is set in the roll paper holder 27. The roll paper P is pressed to the smap roller 24 by the paper-pressing rollers 29, and is fed in the paper-feed direction over the surface of the platen 26 by rotating the smap roller 24. The carriage 28 is pulled by the pull belt 32, which is driven by the carriage motor 30, and is moved along the guide rails 34 in the main scanning direction. Then, while feeding the roll paper P in the paper-feed direction, the carriage 28 is moved in the main scanning direction, and printing is performed by ejecting ink from the plurality of print heads 36 provided on the carriage 28.

Moreover, as shown in FIG. 2, the color inkjet printer 20 has a plurality of cleaning mechanisms 11 serving as an example of cleaning sections for cleaning the print heads 36. The cleaning mechanisms 11 are explained in detail further below.

Configuration of the Print Heads and the Cleaning Mechanisms of the Print Heads

Figure 3:
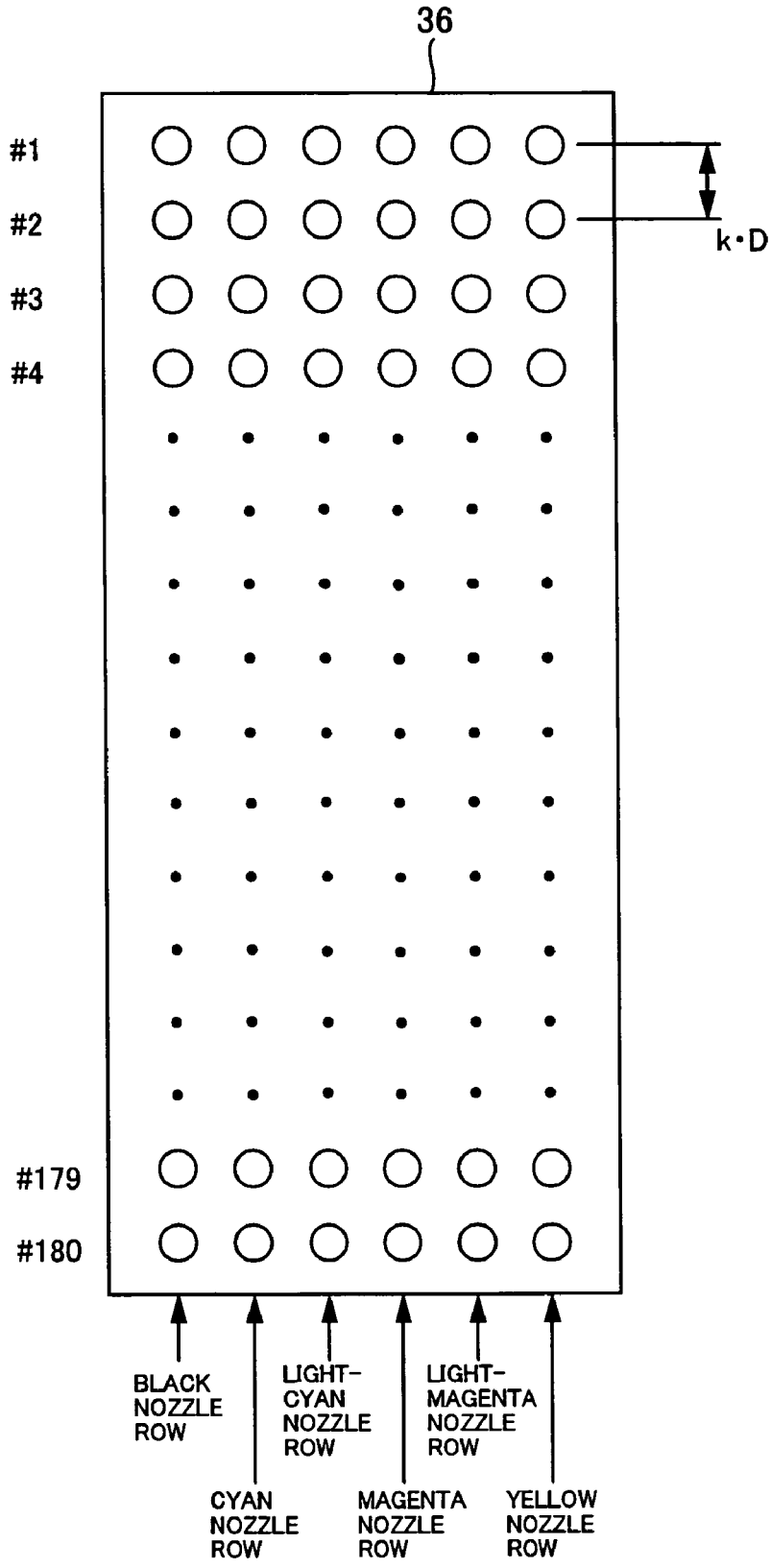
FIG. 3 is an explanatory diagram illustrating an example of a print head 36 according to an embodiment of the present invention.
Figure 4:
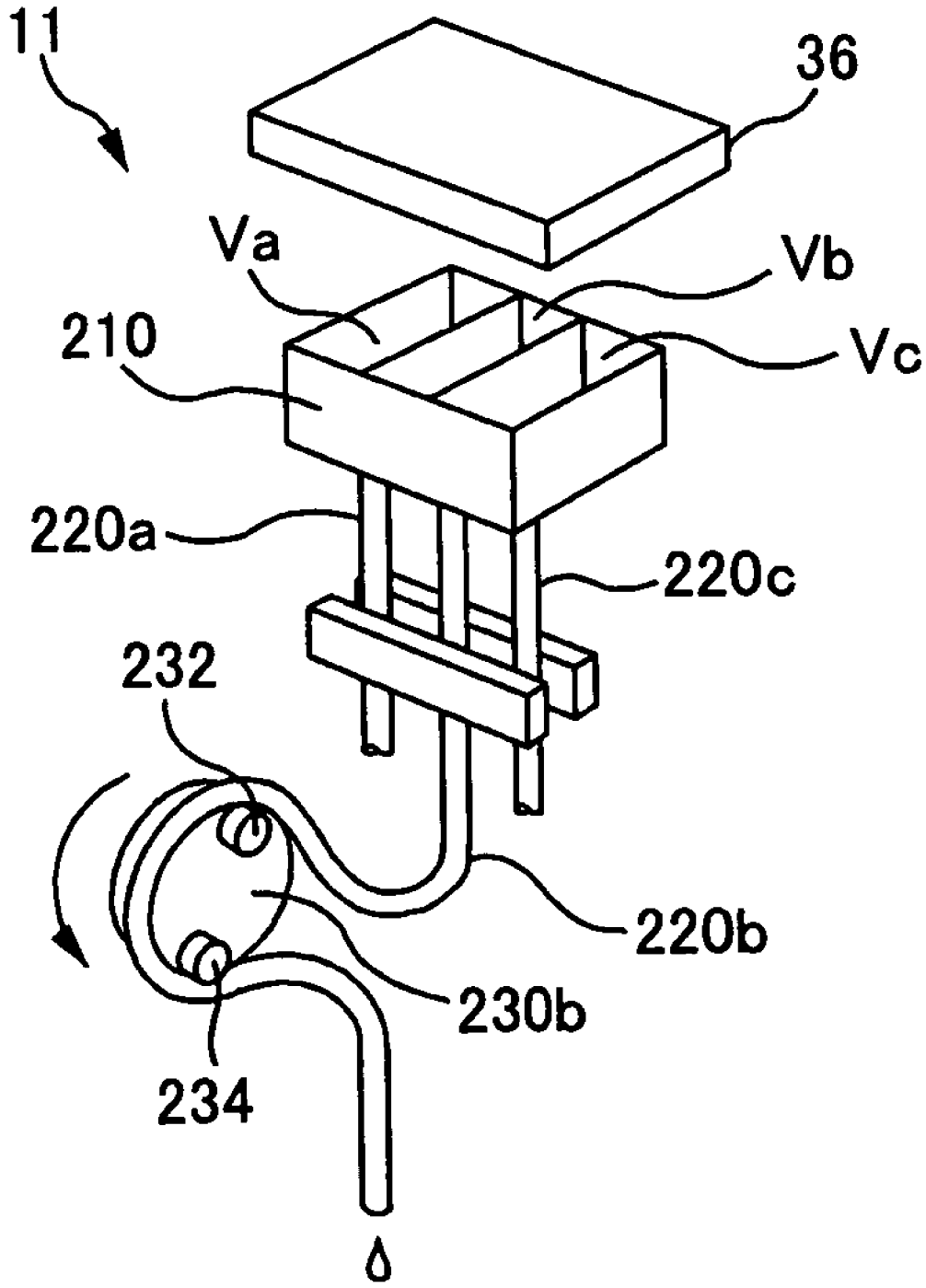
FIG. 4 is an explanatory diagram illustrating an example of a cleaning mechanism 11 in accordance with an embodiment of the present invention.

Referring to FIGS. 3 and 4, the following is an explanation of the configuration of the print heads 36 and the cleaning mechanisms 11. FIG. 3 is an explanatory diagram illustrating the print heads 36. FIG. 4 is an explanatory diagram illustrating the cleaning mechanisms 11.

As shown in FIG. 3, the print heads 36 have a black nozzle row, a cyan nozzle row, a light-cyan nozzle row, a magenta nozzle row, a light-magenta nozzle row, and a yellow nozzle row, respectively arranged on a straight line along the sub-scanning direction.

The black nozzle row includes 180 nozzles, that is, nozzles #1 to #180. The nozzles #1, . . . , #180 of the black nozzle row are arranged at a constant nozzle pitch k·D in the sub-scanning direction. Here, D is the dot pitch in the sub-scanning direction, and k is an integer. The dot pitch D in the sub-scanning direction is equal to the pitch in the main scanning direction (raster line). In the following, the integer k expressing the nozzle pitch k·D is referred to simply as "nozzle pitch k." In the example in FIG. 3, the nozzle pitch k is four dots. However, the nozzle pitch k can be set to any integer.

Moreover, the foregoing is also true for the cyan nozzle row, the light-cyan nozzle row, the magenta nozzle row, the light-magenta nozzle row, and the yellow nozzle row. That is to say, the nozzle rows have 180 nozzles #1 to #180 that are arranged at a constant nozzle pitch k·D in the sub-scanning direction.

Then, when printing, while the print heads 36 are moved at constant speed in the main scanning direction together with the carriage 28, ink drops are ejected from the nozzles. However, depending on the printing method, not all nozzles are used all the time, and sometimes only some of the nozzles are used.

It should be noted that in FIG. 3, the ink colors of the rows have been set to a black nozzle row, a cyan nozzle row, a light-cyan nozzle row, a magenta nozzle row, a light-magenta nozzle row, and a yellow nozzle row, from left to right in the drawing, but there is no limitation to this, and the ink colors may also be arranged in another order.

Figure 5:
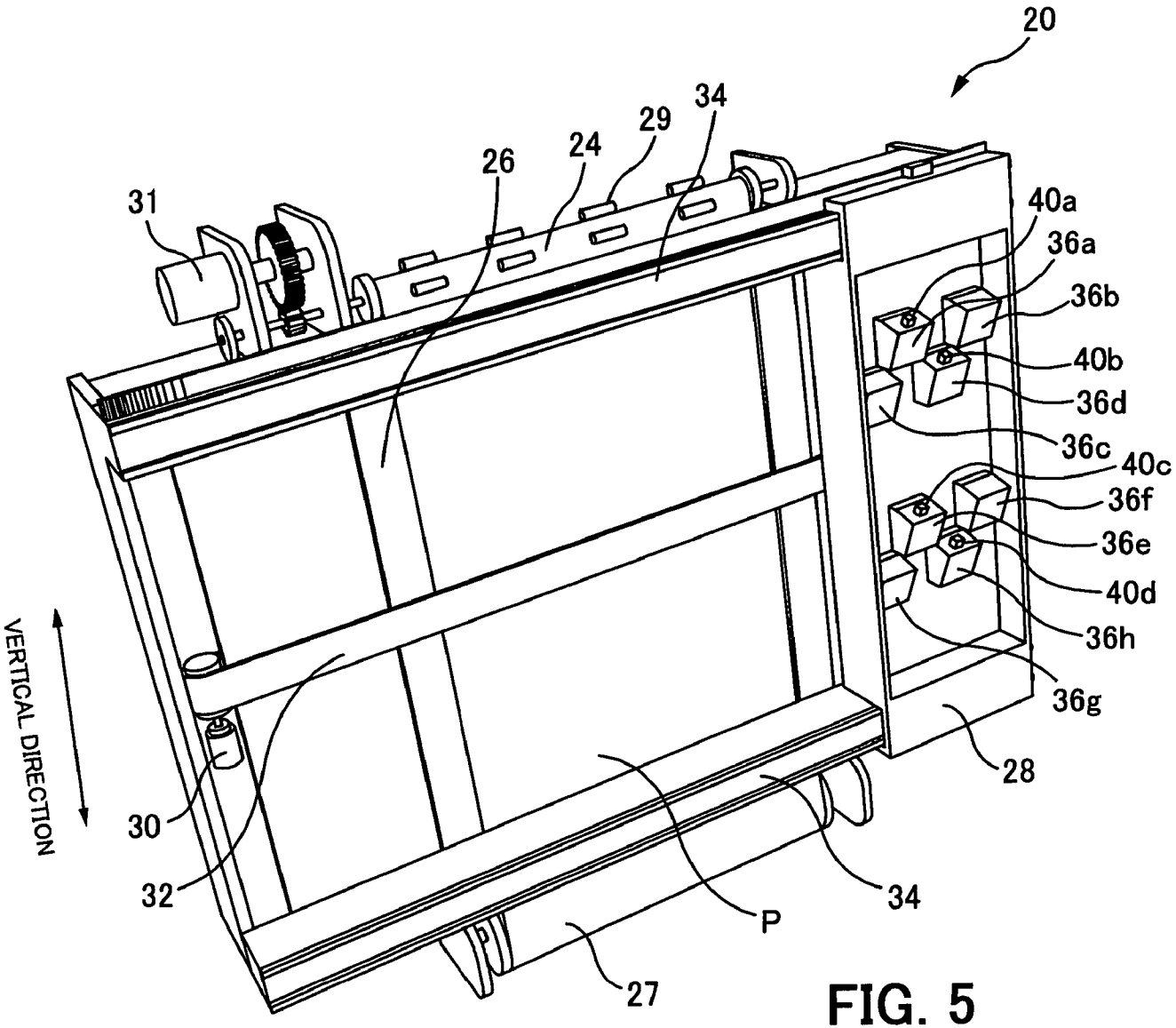
FIG. 5 is a perspective view schematically showing another example of a color inkjet printer 20 according to an embodiment of the present invention.
Figure 6:
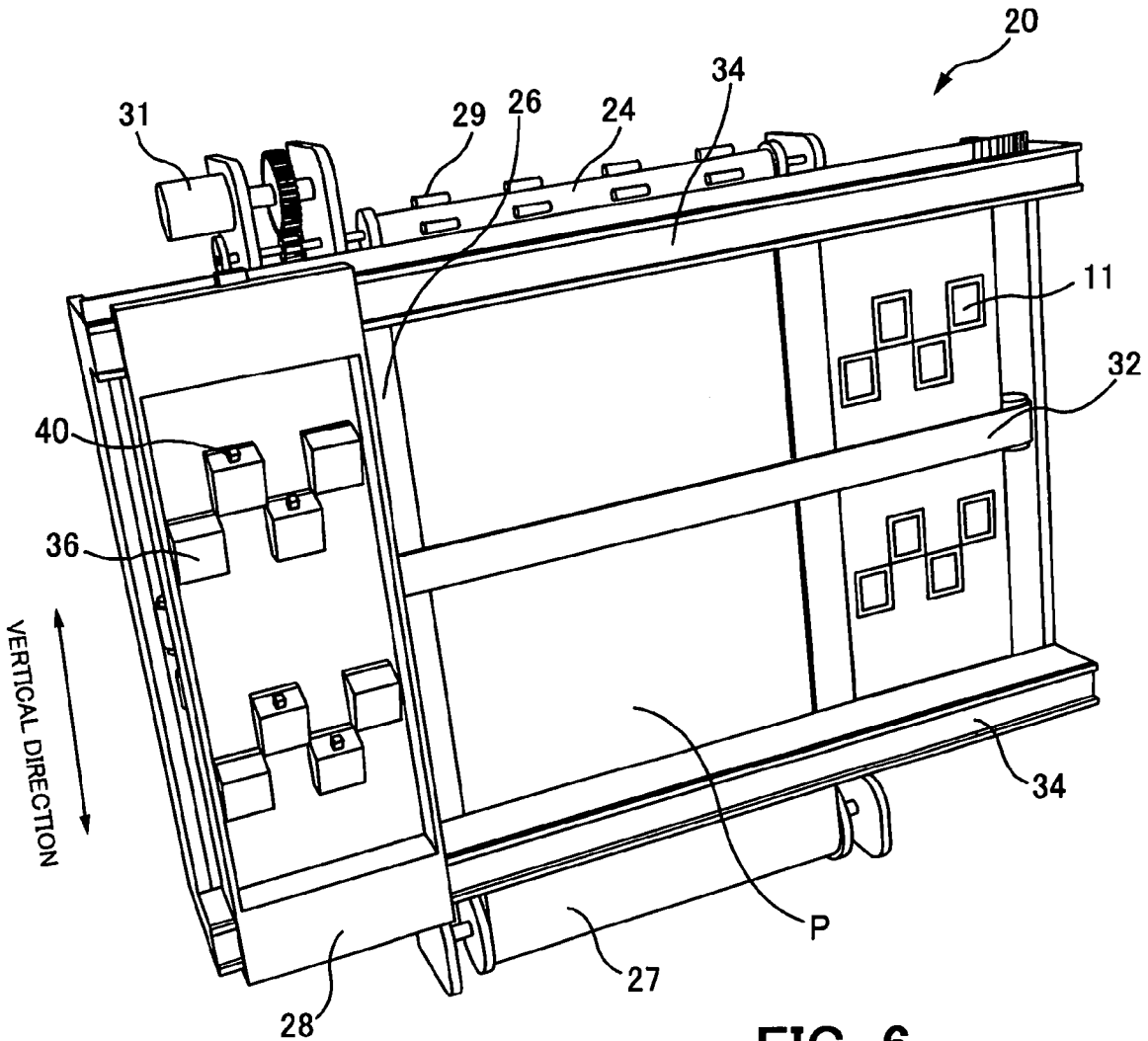
FIG. 6 is a perspective view schematically showing another example of a color inkjet printer 20 according to an embodiment of the present invention.
Figure 7:
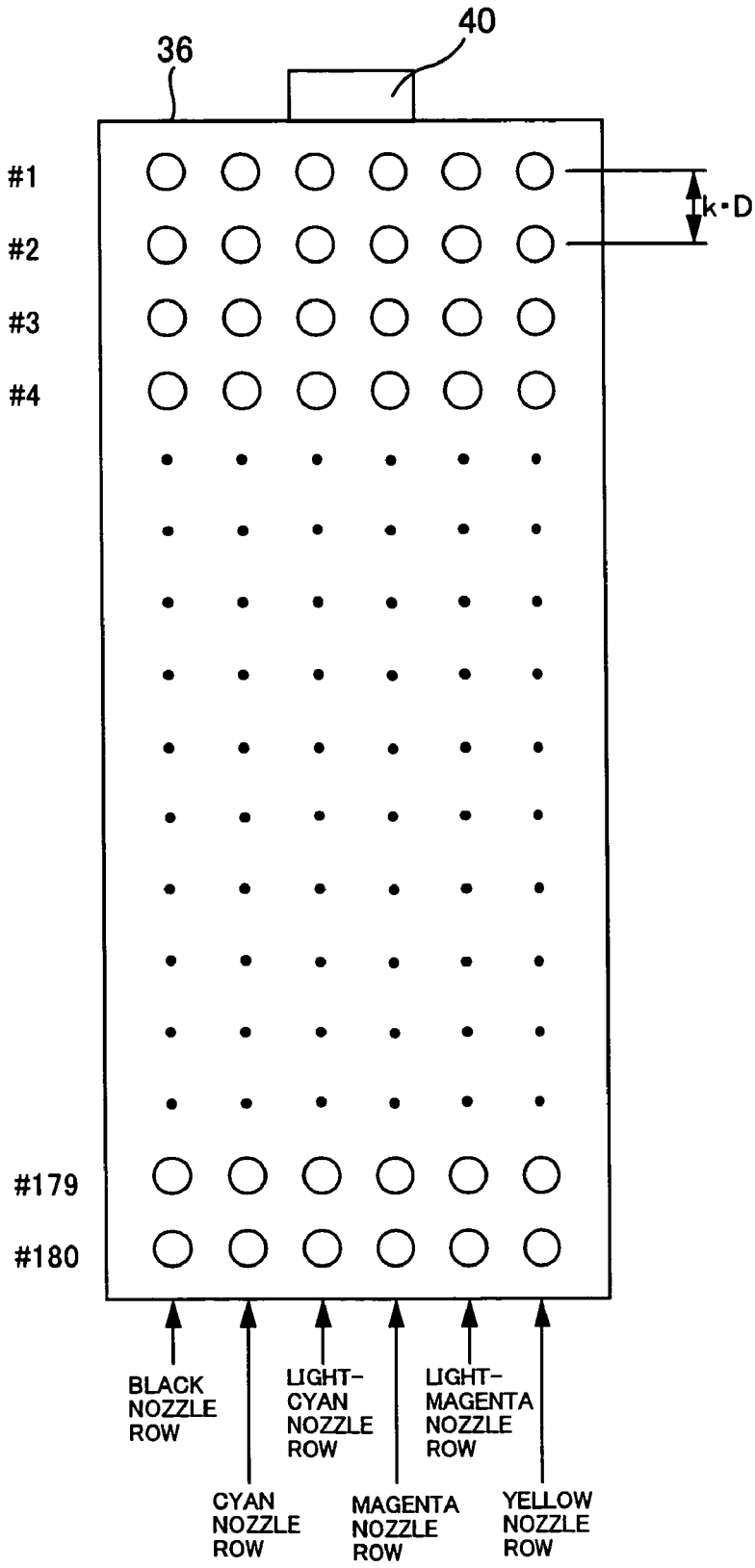
FIG. 7 is an explanatory diagram illustrating another example of a print head 36 according to an embodiment of the present invention.

Moreover, as shown in FIGS. 5 to 7, the print heads 36 (36*a*, 36*b*, 36*c*, 36*d*, 36*e*, 36*f*, 36*g* and 36*h*) may also be provided with temperature sensors 40 (40*a*, 40*b*, 40*c*, 40*d*, 40*e*, 40*f*, 40*g* and 40*h*) as an example of temperature detectors. As is clear from these figures, the temperature sensors 40 are provided on the vertically upper side of the print heads.

As shown in FIG. 4, the cleaning mechanisms 11 include a head cap 210, hoses 220*a*, 220*b* and 220*c*, and pump rollers 230*a*, 230*b* and 230*c*. It should be noted that in FIG. 4, the hoses 220*a* and 220*c* are shown only to an intermediate location, and the pump rollers 230*a* and 230*c* are not shown in FIG. 4, but their configuration and operation should become clear from those for the hose 220*b* and the pump roller 230*b*, whose function is the same, so that duplicate explanations have been omitted. The internal space of the head cap 210 is partitioned into three suction chambers Va, Vb, Vc, as shown in FIG. 4. When the head cap 210 is lifted up, it comes into close contact with the lower side of the print head 36, so that the suction chamber Va forms a closed space covering the black nozzle row and the cyan nozzle row, the suction chamber Vb forms a closed space covering the light-cyan nozzle row and the magenta nozzle row, and the suction chamber Vc forms a closed space covering the light-magenta nozzle row and the yellow nozzle row. The suction chambers Va, Vb and Vc are respectively connected to the hoses 220*a*, 220*b* and 220*c*.

The pump roller 230*b* includes two small rollers 232 and 234 near its periphery. The hose 220*b* is wound around these two rollers 232 and 234. When the pump roller 230*b* is driven by a cleaning motor (not shown in the figure) and rotated in the arrow direction, the air inside the hose 220*b* is pressed by the small rollers 232 and 242, and the closed space inside the head cap 210 is evacuated. As a result, ink is sucked out from the nozzles of the print head 36, and discharged through the hose 220*b* into a waste ink discharge section (not shown in the figure).

It should be noted that when the cleaning mechanism 11 does not operate, the head cap 210 fulfills the function of a protective section for protecting the print head.

First Embodiment of Overall Configuration of Printing System

Figure 8:
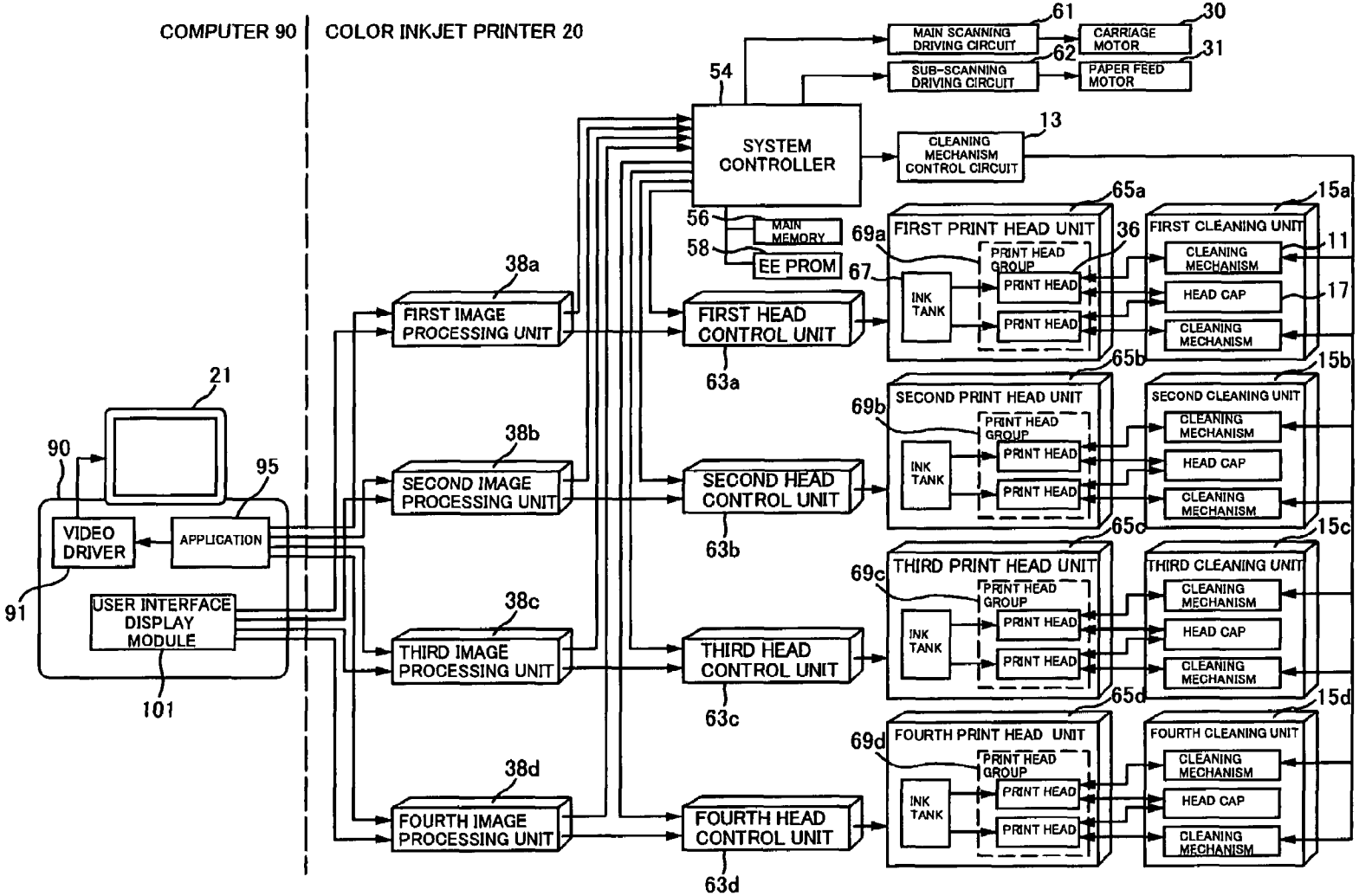
FIG. 8 is a block diagram showing an example of the configuration of a printing system provided with the color inkjet printer 20 according to an embodiment of the present invention.
Figure 9:
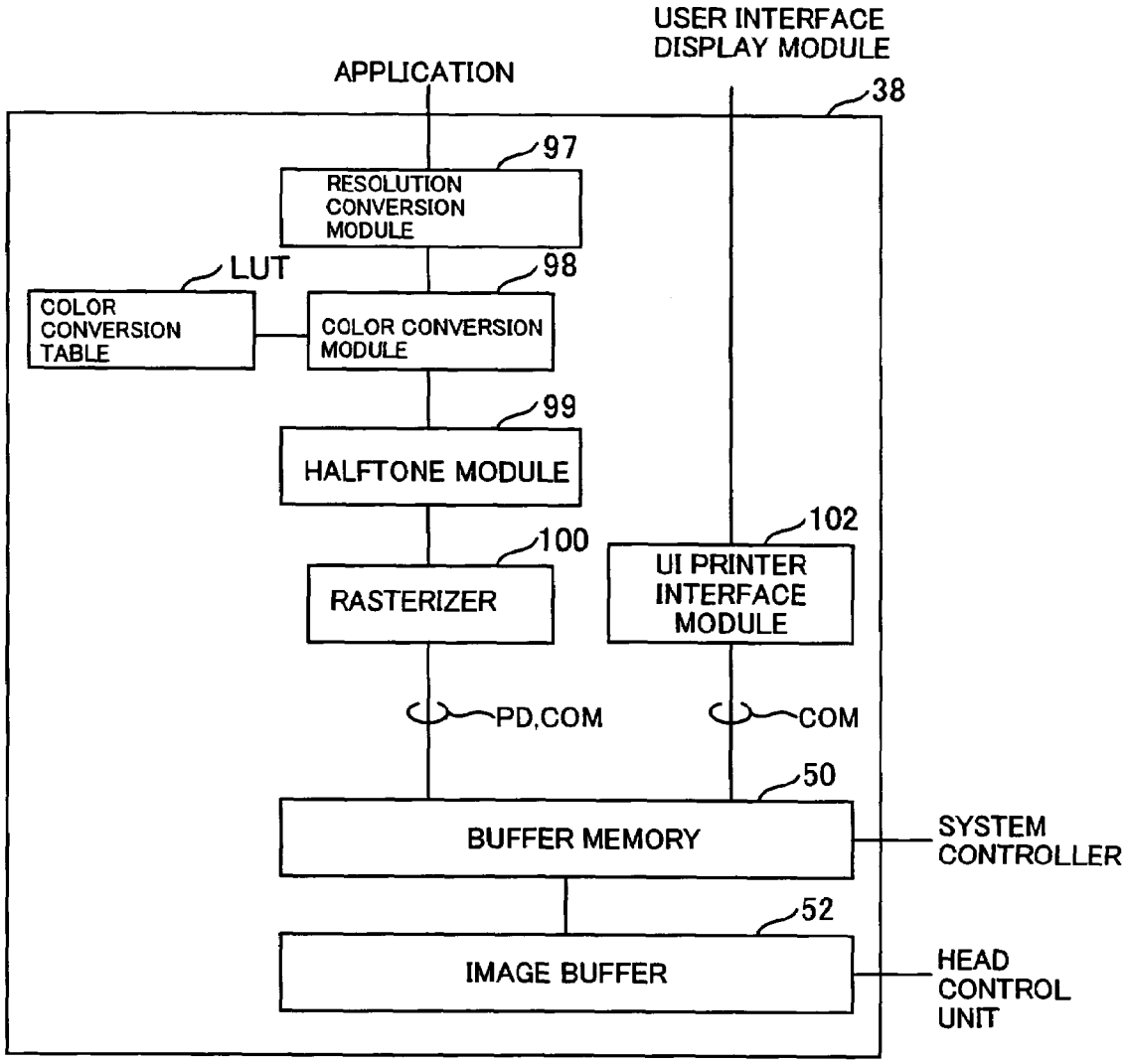
FIG. 9 is a block diagram showing an example of the configuration of an image processing unit 38 according to an embodiment of the present invention.

A first embodiment of the overall configuration of the printing system is explained next, with reference to FIGS. 8 and 9. FIG. 8 is a block diagram showing the configuration of a printing system provided with the color inkjet printer 20 explained above. FIG. 9 is a block diagram showing the configuration of an image processing unit 38.

This printing system includes a computer 90 and a color inkjet printer 20 serving as an example of a printing apparatus. It should be noted that the printing system including the color inkjet printer 20 and the computer 90 can be called a "printing apparatus" in a broad sense. Furthermore, although not shown in the figure, the printing system is constructed from the computer 90, the color inkjet printer 20, a display device such as a CRT 21 or a liquid crystal display device, an input device such as a keyboard or a mouse, and a drive, such as a flexible disk drive or a CD-ROM drive.

An application program 95 is operated on the computer 90 under a predetermined operating system. A video driver 91 is incorporated into the operating system, and the application program 95, which performs image retouching or the like, subjects an image to be processed to the desired processes, or displays the image via the video driver 91 on the CRT 21.

When the application program 95 sends out a print order, the image processing units 38, which are examples of the image processing sections with which the color inkjet printer 20 is provided, receive the image data from the application program 95, and convert the image data into print data PD. As shown in FIG. 9, a resolution conversion module 97, a color conversion module 98, a halftone module 99, a rasterizer 100, a UI printer interface module 102, a color conversion look-up table LUT, a buffer memory 50, and an image buffer 52 are provided inside the image processing units 38.

The role of the resolution conversion module 97 is to convert the resolution of the color image data formed with the application program 95 into a print resolution. The image data whose resolution has been converted is image information made of the three color components R, G and B. Referring to the color conversion look-up table LUT, the color conversion module 98 converts the RGB image data for each pixel into multi-gradation data of the plurality of ink colors that can be used by the color inkjet printer 20.

The color-converted multi-gradation data includes for example 256 gradation values. The halftone module 99 forms halftone image data by executing a so-called halftone process. The halftone image data are rearranged by the rasterizer 100 in the desired data order, and eventually output as print data PD to the buffer memory 50 together with various commands COM. The print data PD include raster data indicating the dot formation state during the main scanning as well as data indicating the paper-feed amount.

On the other hand, a user interface display module 101 provided in the computer 90 has the function of displaying various user interface windows related to printing, and of receiving user input in those windows. The user can, for example, instruct the user interface display module 101 of the type or size of the print paper, or to carry out cleaning of the print heads.

Moreover, a UI printer interface module 102 has the function of serving as an interface between the user interface display module 101 and the color inkjet printer 20. Interpreting the orders that the user has instructed with the user interface, it sends the various types of commands COM to the buffer memory 50, and conversely, interpreting the commands COM received from the buffer memory 50, it performs various types of display on the user interface. For example, the instructions related to the type or size of the print paper, or to the cleaning of the print heads that are received with the user interface display module 101 are sent to the UI printer interface module 102, and the UI printer interface module 102 interprets those orders and sends commands COM to the buffer memory 50.

The printing data PD and the various commands COM that are output by the rasterizer 100, as well as the commands COM that are output by the UI printer interface module 102 are temporarily stored in the buffer memory 50. After the color inkjet printer 20 has received them with the buffer memory 50, it sends them to the image buffer 52 or to a system controller 54. The image buffer 52 stores the print data PD of a plurality of color components that have been received with the buffer memory 50.

In addition to the above-described image processing units 38, the color inkjet printer 20 also includes a system controller 54 that controls the overall operation of the color inkjet printer 20, a main memory 56, and an EEPROM 58. Connected to the system controller 54 are a main scanning driving circuit 61 that drives the carriage motor 30, a sub-scanning driving circuit 62 that drives the paper feed motor 31, head control units 63 which are examples of ink ejection control sections controlling the print heads 36, and a cleaning mechanism control circuit 13.

Inside the color inkjet printer 20, the system controller 54 reads in the necessary information from among the print data from the buffer memory 50, and based on that, sends control signals to the main scanning driving circuit 61, the sub-scanning driving circuit 62, the head control units 63, and so on. Moreover, the head control units 63 read out the print data of the color components from the image buffer 52, in accordance with the control signal from the system controller 54, and drive the nozzles of the various colors provided in the print heads 36 in accordance with the print data. The cleaning mechanism control circuit 13 controls the above-described cleaning mechanisms 11, and lets them clean the print heads.

As shown in FIGS. 1, 2 and 8, the above-described color inkjet printer 20 has a plurality of print heads 36. These print heads are grouped into at least two groups, which are referred to as print head groups 69. For example, in the present embodiment, the number of those print heads 36 is eight, and these are grouped into four print head groups 69 combining two print heads each, that is, a first print head group 69*a*, a second print head group 69*b*, a third print head group 69*c*, and a fourth print head group 69*d*. As shown in FIG. 8, each of the print head groups 69 is arranged to form a separate print head unit 65, that is, the first print head unit 65*a*, the second print head unit 65*b*, the third print head unit 65*c*, and the fourth print head unit 65*d*, and each of the print head units 65 is configured such that each is attachable to and detachable from the printer main unit. Moreover, each of the print head units 65 is provided with an ink tank 67, which is an example of an ink accommodation section for accommodating ink that is supplied to the print heads 36 included in the print head unit 65.

Moreover, the color inkjet printer 20 also has one of the above-described head control units 63 for each print head group 69. Consequently, this embodiment is provided with a first head control unit 63*a* corresponding to the first print head group 69*a*, a second head control unit 63*b* corresponding to the second print head group 69*b*, a third head control unit 63*c* corresponding to the third print head group 69*c*, and a fourth head control unit 63*d* corresponding to the fourth print head group 69*d*. Moreover, the head control units 63 are arranged in individual units, and these head control units 63 are configured such that each of them is attachable to and detachable from the printer main unit.

Similarly, the color inkjet printer 20 has one of the above-described image processing units 38 for each print head group 69. Consequently, this embodiment is provided with a first image processing unit 38*a* corresponding to the first print head group 69*a*, a second image processing unit 38*b* corresponding to the second print head group 69*b*, a third image processing unit 38*c* corresponding to the third print head group 69*c*, and a fourth image processing unit 38*d* corresponding to the fourth print head group 69*d*. Moreover, the image processing units 38 are arranged in individual units, and these image processing units 38 are configured such that each of them is attachable to and detachable from the printer main unit.

The above-mentioned plurality of cleaning mechanisms 11 form at least two cleaning units 15, each of which being arranged in a unit for each print head group 69. That is to say, one cleaning mechanism 11 is provided in correspondence to each print head 36, and therefore in the present embodiment, the number of cleaning mechanisms 11 is eight. Four pairs of cleaning mechanisms 11, in which two cleaning mechanisms each are grouped together in correspondence to the print head groups 69, form four cleaning units 15, that is, a first cleaning unit 15*a*, a second cleaning unit 15*b*, a third cleaning unit 15*c*, and a fourth cleaning unit 15*d*. The individual cleaning units 15 are configured such that each of them is attachable to and detachable from the printer main unit.

The following is an explanation of the operation of the above-described printing system. First, the user gives instructions regarding the type and size of the print paper with the user interface display module 101. Moreover, in the user interface display module 101, it is also possible to give an instruction to print a plurality of images with the respective print head groups 69. Let us assume that in the present embodiment, four images are printed respectively with the four print head groups 69. That is to say, instructions are given such that a first image is printed using the print heads 36 belonging to the first print head group 69*a*, a second image is printed using the print heads 36 belonging to the second print head group 69*b*, a third image is printed using the print heads 36 belonging to the third print head group 69*c*, and a fourth image is printed using the print heads 36 belonging to the fourth print head group 69*d*. The instructions, which are received with the user interface display module 101, are sent to the UI printer interface modules 102 provided in the four image processing units 38*a*, 38*b*, 38*c* and 38*d*. The UI printer interface modules 102 interpret these orders, and send commands COM to the buffer memory 50.

Next, the user gives the application program 95 or the like an instruction to perform printing. When the application program 95, which has received this instruction, sends out a printing order, the above-mentioned four image processing units 38*a*, 38*b*, 38*c* and 38*d* respectively receive the image data of the four images from the application program 95, and after the image data has been converted to print data PD, it is sent to the buffer memory 50 together with various commands COM. The image processing units 38*a*, 38*b*, 38*c* and 38*d* send the print data PD corresponding respectively to the first, second, third and fourth image to the image buffer 52, after receiving the print data PD with their buffer memories 50.

Moreover, after the image processing units 38*a*, 38*b*, 38*c* and 38*d* have received the above-mentioned commands COM with their respective buffer memories 50, they send the commands COM to the system controller 54. Based on the information received from the buffer memories 50 in the image processing units 38*a*, 38*b*, 38*c* and 38*d*, the system controller 54 sends control signals to the main scanning driving circuit 61, the sub-scanning driving circuit 62, and the above-mentioned four head control units 63*a*, 63*b*, 63*c* and 63*d*.

In accordance with the control signals from the system controller 54 the head control units 63*a*, 63*b*, 63*c* and 63*d* read out the print data of each color component from the image buffers 52 in the image processing units 38*a*, 38*b*, 38*c* and 38*d* corresponding to the respective head control units 63. Then, the head control units 63*a*, 63*b*, 63*c* and 63*d* control the print heads 36 belonging to the respectively corresponding print head groups 69*a*, 69*b*, 69*c* and 69*d* in accordance with the data that has been read out.

Then, while controlling the paper feed motor 31 with the sub-scanning driving circuit 62 in order to feed the roll paper P, the carriage motor 30 is controlled with the main scanning driving circuit 61 so as to move the carriage 28 in the main scanning direction, and ink is ejected from the print heads 36 controlled by the respective print head control units 63*a*, 63*b*, 63*c* and 63*d*, thus printing on the roll paper P.

It should be noted that the images are printed on the roll paper P in the order in which the processing of the first image, the second image, the third image, and the fourth image with the image processing unit 38*a*, 38*b*, 38*c* and 38*d*, respectively, has been terminated. That is to say, the printing of the images on the roll paper P does not start after waiting until all image processing of the four images has been finished, but the first to fourth images are independently processed and printed onto the roll paper P.

The following is an explanation of the printing system's operation for cleaning the print heads 36. First, the user gives with the user interface display module 101 an instruction to perform cleaning as well as to designate the print heads 36 to be cleaned. The instruction received with the user interface display module 101 is sent to those of the four image processing units 38*a*, 38*b*, 38*c* and 38*d* that correspond to the print head groups 69 including the designated print heads 36 to be cleaned. Here, it is assumed that the target image processing unit, which includes the designated print heads 36, is the first image processing unit 38*a*.

The first image processing unit 38*a* receives the instruction with its UI printer interface module 102, and the UI printer interface module 102 interprets the order and sends a command COM to the buffer memory 50. Moreover, after the first image processing unit 38*a* has received this command COM with its buffer memory 50, it sends the command COM to the system controller 54.

Based on the information received from the buffer memory 50 in the image processing unit 38*a*, the system controller 54 sends a control signal to the cleaning mechanism control circuit 13.

Then, controlling the cleaning mechanisms 11 provided in the first cleaning unit 15*a* with the cleaning mechanism control circuit 13, cleaning of the print heads 36 provided in the first print head unit 65*a* is performed with the above-described method.

Thus, by providing an image processing unit for each of the at least two print head groups into which the plurality of print heads have been grouped, it is possible to realize a color inkjet printer with high customizability.

That is to say, as explained for the problems to be solved by the invention, the above-described color inkjet printer, which has a plurality of print heads, can be expected to have higher customizability, due to being provided with a plurality of print heads, than a color inkjet printer having only a single print head. For example, there is the possibility to easily realize a customization, such as allowing printing with only the other print heads when some of the print heads cannot be used as a result of a defect or the like, or grouping the plurality of print heads into at least two print head groups and printing a plurality of independent images with the print head groups.

However, even though there are a plurality of print heads, if there is only one image processing unit for processing the images to be printed with the print heads, there are difficulties in the easy realization of the above-described customization.

In order to address this problem, an image processing unit is thus provided for each of the at least two print head groups into which the plurality of print heads have been grouped.

Thus, for example, in the case that some of the print heads cannot be used as a result of a defect or the like and that printing is allowed with only the other print heads, it is possible to ensure proper customizability of the color ink-jet printer by using only the image processing units corresponding to the print head groups to which the other print heads belong.

Moreover, when printing a plurality of individual images with the at least two print head groups into which the plurality of print heads have been grouped, it is possible to ensure proper customizability of the color inkjet printer by processing the images independently with the image processing units for the corresponding print head groups.

Consequently, it is possible to realize a color ink-jet printer with high customizability, as stated above.

It should be noted that in the foregoing, the number of print heads was set to eight, but there is no limitation to this, and any plural number of print heads may be used.

Moreover, in the foregoing, the eight print heads have been divided into four print head groups of two print heads each, but there is no limitation to this kind of division. For example, it is also possible to divide the eight print heads into three print head groups, and let two of those print head groups have three print heads and let the remaining one print head group have two print heads. Moreover, the print head groups may also have only one print head.

Moreover, in the foregoing, it was assumed that four images are printed with four print head groups, but there is no limitation to this, and it is for example also possible to print one image using the four print head groups.

Moreover, in the foregoing, the image processing unit shown in FIG. 9 was given as one example of the image processing section, but there is no limitation to this, and any image processing section is possible as long as it can process the images that are output from the application or the like in order to send out print data to the head control units 63. For example, it is not necessarily required to look up the color conversion table when performing the color conversion with the color conversion modules 98, and it is also not necessarily required to execute a halftone process when carrying out the image processing. Moreover, the image processing sections do not have to include a function related to the user interface, such as the UI printer interface module 102.

Second Embodiment of Overall Configuration of Printing System

Figure 10:
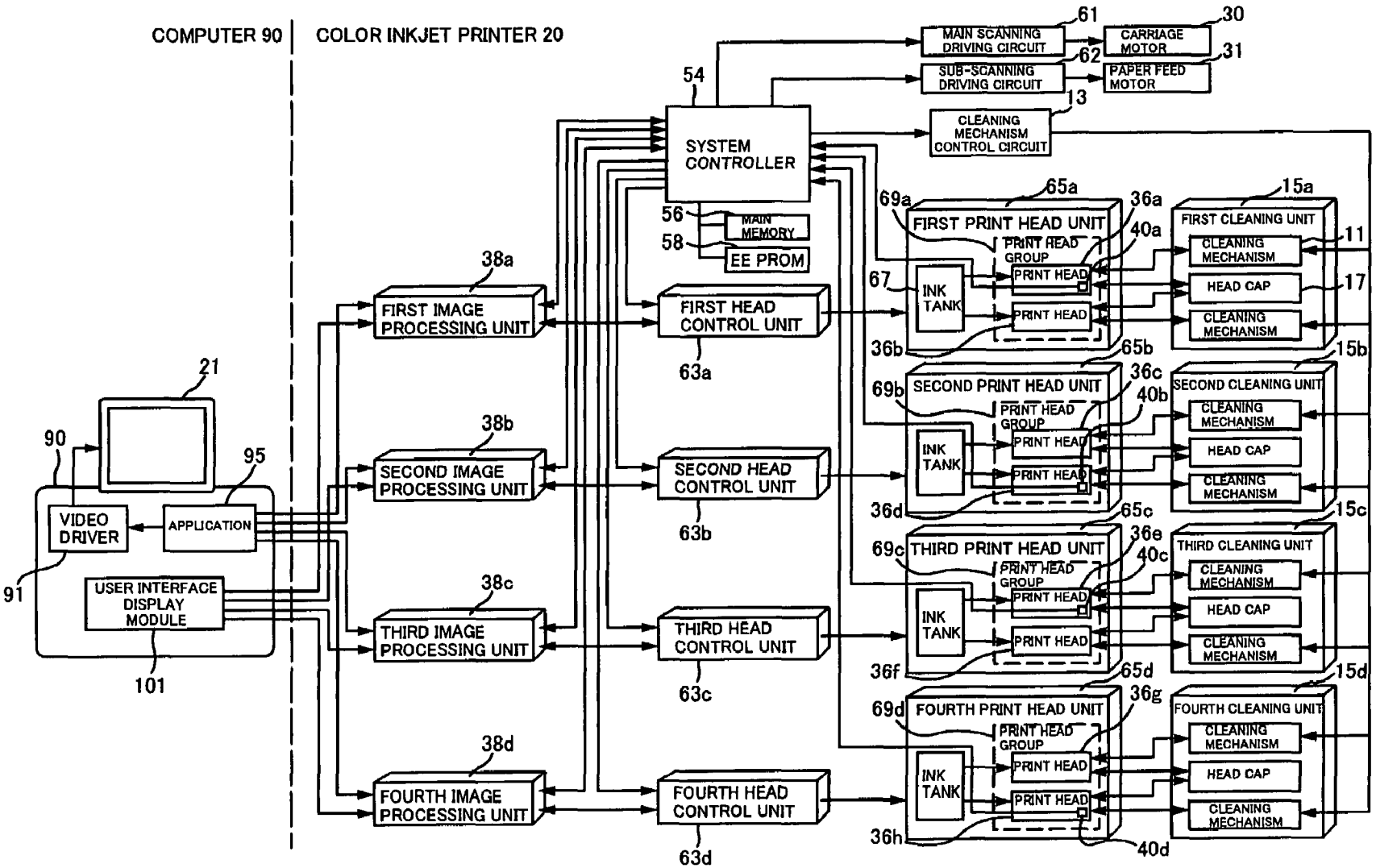
FIG. 10 is a block diagram showing another example of the configuration of a printing system provided with the color inkjet printer 20 according to an embodiment of the present invention.

A second embodiment of the overall configuration of the printing system is explained next, with reference to FIGS. 9 and 10. FIG. 9 is a block diagram showing the configuration of an image processing unit 38. (It should be noted that in this embodiment, the image processing units 38 are configured the same as in the first embodiment, so that the same FIG. 9 as for the first embodiment is used for the explanations.) FIG. 10 is a block diagram showing the configuration of a printing system provided with the color inkjet printer 20 explained above. Note that structural elements that are the same as in the first embodiment have been denoted by the same reference numerals as used in the first embodiment.

This printing system includes a computer 90 and a color inkjet printer 20 serving as an example of a printing apparatus. It should be noted that the printing system including the color inkjet printer 20 and the computer 90 can be called a "printing apparatus" in a broad sense. Furthermore, although not shown in the figure, the printing system is constructed from the computer 90, the color inkjet printer 20, a display device such as a CRT 21 or a liquid crystal display device, an input device such as a keyboard or a mouse, and a drive, such as a flexible disk drive or a CD-ROM drive.

An application program 95 is operated on the computer 90 under a predetermined operating system. A video driver 91 is incorporated into the operating system, and the application program 95, which performs image retouching or the like subjects an image to be processed to the desired processes, or displays the image via the video driver 91 on the CRT 21.

When the application program 95 sends out a print order, the image processing units 38, which are examples of the image processing section with which the color inkjet printer 20 is provided, receive the image data from the application program 95, and convert the image data into print data PD. As shown in FIG. 9, a resolution conversion module 97, a color conversion module 98, a halftone module 99, a rasterizer 100, a UI printer interface module 102, a color conversion look-up table LUT, a buffer memory 50, and an image buffer 52 are provided inside the image processing units 38.

The role of the resolution conversion module 97 is to convert the resolution of the color image data formed with the application program 95 into a print resolution. The image data whose resolution has been converted is image information made of the three color components R, G and B. Referring to the color conversion look-up table LUT, the color conversion module 98 converts the RGB image data for each pixel into multi-gradation data of the plurality of ink colors that can be used by the color inkjet printer 20.

The color-converted multi-gradation data includes for example 256 gradation values. The halftone module 99 forms halftone image data by executing a so-called halftone process. The halftone image data are rearranged by the rasterizer 100 in the desired data order, and eventually output as print data PD to the buffer memory 50 together with various commands COM. The print data PD include raster data indicating the dot formation state during the main scanning as well as data indicating the paper-feed amount.

On the other hand, a user interface display module 101 provided in the computer 90 has the function of displaying various user interface windows related to printing, and of receiving user input in those windows. The user can, for example, instruct the user interface display module 101 of the type or size of the print paper, or to carry out cleaning of the print heads.

Moreover, a UI printer interface module 102 has the function of serving as an interface between the user interface display module 101 and the color inkjet printer 20. Interpreting the orders that the user has instructed with the user interface, it sends the various types of commands COM to the buffer memory 50, and conversely, interpreting the commands COM received from the buffer memory 50, it performs various types of display on the user interface. For example, the instructions related to the type or size of the print paper, or to the cleaning of the print heads that are received with the user interface display module 101 are sent to the UI printer interface module 102, and the UI printer interface module 102 interprets those orders and sends commands COM to the buffer memory 50.

The printing data PD and the various commands COM that are output by the rasterizer 100, as well as the commands COM that are output by the UI printer interface module 102 are temporarily stored in the buffer memory 50. After the color inkjet printer 20 has received them with the buffer memory 50, it sends them to the image buffer 52 or to a system controller 54. The image buffer 52 stores the print data PD of a plurality of color components that have been received with the buffer memory 50.

In addition to the above-described image processing units 38, the color inkjet printer 20 also includes a system controller 54 that controls the overall operation of the color inkjet printer 20, a main memory 56, and an EEPROM 58. Connected to the system controller 54 are a main scanning driving circuit 61 that drives the carriage motor 30, a sub-scanning driving circuit 62 that drives the paper feed motor 31, head control units 63 which are examples of ink ejection control sections controlling the print heads 36, a cleaning mechanism control circuit 13, which is an example of a cleaning control section, and the above-noted temperature sensors 40.

Inside the color inkjet printer 20, the system controller 54 reads in the necessary information from among the print data from the buffer memory 50, and based on that, sends control signals to the main scanning driving circuit 61, the sub-scanning driving circuit 62, the head control units 63, and so on. Moreover, the head control units 63 read out the print data of the color components from the image buffer 52, in accordance with the control signal from the system controller 54, and drive the nozzles of the various colors provided in the print heads 36 in accordance with the print data. The cleaning mechanism control circuit 13 controls the above-described cleaning mechanisms 11, and lets them clean the print heads. Moreover, the temperature sensors 40 detect the temperature inside the print head units 65, which are explained below, and output information related to the detected temperature to the system controller 54.

As shown in FIGS. 5, 6 and 10, the above-described color inkjet printer 20 has a plurality of print heads 36. These print heads are grouped into at least two groups, which are referred to as print head groups 69. For example, in the present embodiment, the number of those print heads 36 is eight, and these are grouped into four print head groups 69 combining two print heads each, that is, a first print head group 69*a*, a second print head group 69*b*, a third print head group 69*c*, and a fourth print head group 69*d*. As shown in FIG. 10, each of the print head groups 69 is arranged to form a separate print head unit 65, that is, the first print head unit 65*a*, the second print head unit 65*b*, the third print head unit 65*c*, and the fourth print head unit 65*d*, and each of the print head units 65 is configured such that each is attachable to and detachable from the printer main unit. Moreover, each of the print head units 65 is provided with an ink tank 67, which is an example of an ink accommodation section for accommodating ink that is supplied to the print heads 36 included in the print head unit 65.

It should be noted that in this embodiment, the first print head unit 65*a*, the second print head unit 65*b*, the third print head unit 65*c*, and the fourth print head unit 65*d* respectively have a first temperature sensor 40*a*, a second temperature sensor 40*b*, a third temperature sensor 40*c*, and a fourth temperature sensor 40*d*. The temperature sensors 40 detect the temperature within the corresponding print head unit 65. In this example, the first temperature sensor 40*a* is provided in the print head 36*a* of the two print heads 36*a* and 36*b* arranged in the first print head unit 65*a*, the second temperature sensor 40*b* is provided in the print head 36*d* of the two print heads 36*c* and 36*d* arranged in the second print head unit 65*b*, the third temperature sensor 40*c* is provided in the print head 36*e* of the two print heads 36*e* and 36*f* arranged in the third print head unit 65*c*, and the fourth temperature sensor 40*d* is provided in the print head 36*h* of the two print heads 36*g* and 36*h* arranged in the fourth print head unit 65*d*.

Moreover, the color inkjet printer 20 also has one of the above-described head control units 63 for each print head group 69. Consequently, this embodiment is provided with a first head control unit 63*a* corresponding to the first print head group 69*a*, a second head control unit 63*b* corresponding to the second print head group 69*b*, a third head control unit 63*c* corresponding to the third print head group 69*c*, and a fourth head control unit 63*d* corresponding to the fourth print head group 69*d*. The head control units 63 are arranged in individual units, and these head control units 63 are configured such that each of them is attachable to and detachable from the printer main unit.

Similarly, the color inkjet printer 20 has one of the above-described image processing units 38 for each print head group 69. Consequently, this embodiment is provided with a first image processing unit 38*a* corresponding to the first print head group 69*a*, a second image processing unit 38*b* corresponding to the second print head group 69*b*, a third image processing unit 38*c* corresponding to the third print head group 69*c*, and a fourth image processing unit 38*d* corresponding to the fourth print head group 69*d*. The image processing units 38 are arranged in individual units, and these image processing units 38 are configured such that each of them is attachable to and detachable from the printer main unit.

The above-mentioned plurality of cleaning mechanisms 11 form at least two cleaning units 15, each of which being arranged in a unit for each print head group 69. That is to say, one cleaning mechanism 11 is provided in correspondence to each print head 36, and therefore in the present embodiment, the number of cleaning mechanisms 11 is eight. Four pairs of cleaning mechanisms 11, in which two cleaning mechanisms each are grouped together in correspondence to the print head groups 69, form four cleaning units 15, that is, a first cleaning unit 15*a*, a second cleaning unit 15*b*, a third cleaning unit 15*c*, and a fourth cleaning unit 15*d*. The individual cleaning units 15 are configured such that each of them is attachable to and detachable from the printer main unit.

The following is an explanation of the operation of the above-described printing system. First, the user gives instructions regarding the type and size of the print paper with the user interface display module 101. Moreover, in the user interface display module 101, it is also possible to give an instruction to print a plurality of images with the corresponding print head groups 69. Let us assume that in the present embodiment, four images are printed respectively with the four print head groups 69. That is to say, instructions are given such that a first image is printed using the print heads 36 belonging to the first print head group 69*a*, a second image is printed using the print heads 36 belonging to the second print head group 69*b*, a third image is printed using the print heads 36 belonging to the third print head group 69*c*, and a fourth image is printed using the print heads 36 belonging to the fourth print head group 69*d*. The instructions, which are received with the user interface display module 101, are sent to the UI printer interface modules 102 provided in the four image processing units 38*a*, 38*b*, 38*c* and 38*d*. The UI printer interface modules 102 interpret these orders, and send commands COM to the buffer memory 50.

Next, the user gives the application program 95 or the like an instruction to perform printing. When the application program 95, which has received this instruction, sends out a printing order, the above-mentioned four image processing units 38*a*, 38*b*, 38*c* and 38*d* respectively receive the image data of the four images from the application program 95, and after the image data has been converted to print data PD, it is sent to the buffer memory 50 together with various commands COM. The image processing units 38*a*, 38*b*, 38*c* and 38*d* send the print data PD corresponding respectively to the first, second, third and fourth image to the image buffer 52, after receiving the print data PD with their buffer memories 50.

Moreover, after the image processing units 38*a*, 38*b*, 38*c* and 38*d* have received the above-mentioned commands COM with their respective buffer memories 50, they send the commands COM to the system controller 54. Based on the information received from the buffer memories 50 in the image processing units 38*a*, 38*b*, 38*c* and 38*d*, the system controller 54 sends control signals to the main scanning driving circuit 61, the sub-scanning driving circuit 62, and the above-mentioned four head control units 63*a*, 63*b*, 63*c* and 63*d*.

In accordance with the control signals from the system controller 54 the head control units 63*a*, 63*b*, 63*c* and 63*d* read out the print data of each color component from the image buffers 52 in the image processing units 38*a*, 38*b*, 38*c* and 38*d* corresponding to the respective head control units 63. Then, the head control units 63*a*, 63*b*, 63*c* and 63*d* control the print heads 36 belonging to the respectively corresponding print head groups 69*a*, 69*b*, 69*c* and 69*d* in accordance with the data that has been read out.

Then, while controlling the paper feed motor 31 with the sub-scanning driving circuit 62 in order to feed the roll paper P, the carriage motor 30 is controlled with the main scanning driving circuit 61 so as to move the carriage 28 in the main scanning direction, and ink is ejected from the print heads 36 controlled by the respective print head control units 63*a*, 63*b*, 63*c* and 63*d*, thus printing on the roll paper P.

It should be noted that while executing the above procedure, the temperature sensors 40 occasionally detect the temperature inside the print head units 65, and output information related to the detected temperature to the system controller 54. Then, in accordance with this output, the system controller 54 controls with the above-described head control units 63 the ejection of ink with the print heads 36 provided in the print head units 65 in which the temperature sensors 40 that have made the output are arranged. In the present embodiment, if the output from one of the temperature sensors exceeds a predetermined value, that is, if the temperature exceeds a predetermined temperature, then the ejection of ink with the print heads 36 in the print head unit 65 in which the temperature sensor 40 that has made that output are arranged is stopped in order to prevent damage to the components inside that print head unit.

For example, if the output of the temperature sensor 40*b* among the four temperature sensors 40*a*, 40*b*, 40*c* and 40*d* exceeds a predetermined value, then the ejection of ink with the print heads 36*c* and 36*d* in the print head unit 65*b* is stopped by control with the head control unit 63*b*. The result of this operation is that the printing of the second image on the roll paper P is stopped.

The following is an explanation of the printing system's operation for cleaning the print heads 36. First, the user gives with the user interface display module 101 an instruction to perform cleaning as well as to designate the print heads 36 to be cleaned. The instruction received with the user interface display module 101 is sent to those of the four image processing units 38*a*, 38*b*, 38*c* and 38*d* that correspond to the print head groups 69 including the designated print heads 36 to be cleaned. Here, it is assumed that the target image processing unit, which includes the designated print heads 36, is the first image processing unit 38*a*.

The first image processing unit 38*a* receives the instruction with its UI printer interface module 102, and the UI printer interface module 102 interprets the order and sends a command COM to the buffer memory 50. Moreover, after the first image processing unit 38*a* has received this command COM with its buffer memory 50, it sends the command COM to the system controller 54.

Based on the information received from the buffer memory 50 in the image processing unit 38*a*, the system controller 54 sends a control signal to the cleaning mechanism control circuit 13.

Then, controlling the cleaning mechanisms 11 provided in the first cleaning unit 15*a* with the cleaning mechanism control circuit 13, cleaning of the print heads 36 provided in the first print head unit 65*a* is performed with the above-described method.

It should be noted that while executing the above procedure, the temperature sensors 40 occasionally detect the temperature inside the print head units 65, and output information related to the detected temperature to the system controller 54. Then, in accordance with this output, the system controller 54 controls with the cleaning mechanism control circuit 13 a cleaning quantity of the print heads 36 with the cleaning mechanism 11. In the present embodiment, the cleaning mechanism control circuit 13 controls the frequency with which the print heads 36 are cleaned with the cleaning mechanism 11 such that it is changed in accordance with the output of the temperature sensors.

Since the viscosity of the ink fluctuates with changes in the temperature, a method is effective that sets a cleaning frequency that is appropriate for this fluctuating viscosity. From this viewpoint, instead of changing the cleaning frequency, it is also possible to change the force with which the ink is sucked out during cleaning.

Thus, by providing an image processing unit for each of the at least two print head groups into which the plurality of print heads have been grouped, and providing each of the print head groups with a temperature sensor, it is possible to realize a color inkjet printer with high customizability.

That is to say, as explained for the problems to be solved by the invention, the above-described color inkjet printer, which has a plurality of print heads, can be expected to have higher customizability, due to being provided with a plurality of print heads, than a color inkjet printer having only a single print head. For example, there is the possibility to easily realize a customization, such as allowing printing with only the other print heads when some of the print heads cannot be used as a result of a defect or the like, or grouping the plurality of print heads into at least two print head groups and printing a plurality of independent images with the print head groups. Thus, providing an image processing unit for each of the at least two print head groups into which the plurality of print heads have been grouped is advantageous with regard to realizing a color inkjet printer with high customizability.

However, in this situation, even though there are a plurality of print heads, if there is only one temperature detector, there are difficulties in the easy realization of the above-described customization.

In order to address this problem, an image processing unit is provided for each of the at least two print head groups into which the plurality of print heads have been grouped, and a temperature sensor is provided for each print head group.

Thus, when allowing printing with only the other print heads when some of the print heads cannot be used as a result of a defect or the like, it is possible to ensure proper customizability of the color inkjet printer by detecting the temperature with the temperature sensors corresponding to the print head groups to which the other print heads belong, thus allowing various controls in accordance with the temperature.

Moreover, when printing a plurality of images individually with at least two print head groups into which the plurality of print heads have been grouped, it is possible to ensure proper customizability of the color inkjet printer by detecting the temperature with the temperature sensors corresponding to the print head groups to which the other print heads belong, thus allowing various controls in accordance with the temperature.

Consequently, it is possible to realize a color ink-jet printer with high customizability, as stated above.

It should be noted that in the foregoing, the number of print heads was set to eight, but there is no limitation to this, and any plural number of print heads may be used.

Moreover, in the foregoing, the eight print heads have been divided into four print head groups of two print heads each, but there is no limitation to this kind of division. For example, it is also possible to divide the eight print heads into three print head groups, and let two of those print head groups have three print heads each and let the remaining one print head group have two print heads. Moreover, the print head groups may also have only one print head.

Moreover, in the foregoing, it was assumed that four images are printed with four print head groups, but there is no limitation to this, and it is for example also possible to print one image using the four print head groups.

Moreover, in the foregoing, the image processing unit shown in FIG. 9 was given as one example of the image processing sections, but there is no limitation to this, and any image processing section is possible as long as it can process the images that are output from the application or the like in order to send out print data to the head control units 63. For example, it is not necessarily required to look up the color conversion table when performing the color conversion with the color conversion modules 98, and it is also not necessarily required to execute a halftone process when carrying out the image processing. Moreover, the image processing section does not have to include a function related to the user interface, such as the UI printer interface module 102.

Other Embodiments

In the foregoing, a printing apparatus according to the present invention was explained based on embodiments, but the above-described embodiments of the present invention are merely to facilitate the understanding of the present invention, and are in no way meant to limit the present invention. Needless to say, modifications and improvements not parting from the spirit of the present invention are possible, and equivalents thereof are intended to be embraced in the present invention.

The above embodiments have been explained by taking print paper as an example of the medium to be printed, but it is also possible to use film, cloth or metal sheets or the like as the medium to be printed. Moreover, the above embodiments have been explained by taking roll paper as an example of the print paper, but it is also possible to use A0 paper or B0 paper as the print paper.

Moreover, the above embodiments have been explained for a color inkjet printer, but the present invention can also be applied to a monochrome inkjet printer.

Also, in the above embodiments, at least two image processing units are individually arranged in units, and these image processing units are configured to be detachable with respect to the printer main unit, but there is no limitation to this.

However, in the above embodiments, the number of image processing units used can be easily adjusted in accordance with a user's needs regarding printing, such as the size of the printed image or the printing speed, so that the above embodiments are preferable with regard to improving customizability.

Moreover, in the above embodiments, a head control unit for controlling the ejection of ink with the print heads was arranged for each print head group, but there is no limitation to this.

However, the above embodiment is preferable in that high customizability due to providing a plurality of print heads can thus be displayed more efficiently.

Moreover, in the above embodiments, at least two head control units are individually arranged in units, and these head control units are configured to be detachable with respect to the printer main unit, but there is no limitation to this.

However, in the above embodiments, the number of head control units used can be easily adjusted in accordance with a user's needs regarding printing, such as the size of the printed image or the printing speed, so that the above embodiments are preferable with regard to improving customizability.

(1) In the above embodiments, the print head groups form print head units arranged in units, and these print head units are configured to be detachable with respect to the printer main unit, but there is no limitation to this.

However, in the above embodiments, the number of print head units used can be easily adjusted in accordance with a user's needs regarding printing, such as the size of the printed image or the printing speed, so that the above embodiments are preferable with regard to improving customizability.

Moreover, in the above embodiments, the print head groups form print head units arranged in units, and these print head units are configured to have ink tanks for accommodating the ink that is supplied to the print heads provided in those print head units, but there is no limitation to this.

However, in the above embodiments, the number of ink tanks can be easily adjusted in accordance with a user's needs regarding printing, such as the size of the printed image or the printing speed, so that the above embodiments are preferable with regard to improving customizability.

Moreover, in the above embodiments, a plurality of cleaning mechanisms for cleaning the print heads were provided, and this plurality of cleaning mechanisms forms at least two cleaning units for each print head group, and those cleaning units are configured to be detachable with respect to the printer main unit, but there is no limitation to this.

However, in the above embodiments, the number of cleaning units can be easily adjusted in accordance with a user's needs regarding printing, such as the size of the printed image or the printing speed, so that the above embodiments are preferable with regard to improving customizability.

Moreover, in the above embodiments, the cleaning units are provided with a head cap for protecting the print heads, but there is no limitation to this.

However, in the above embodiments, the number of head caps can be easily adjusted in accordance with a user's needs regarding printing, such as the size of the printed image or the printing speed, so that the above embodiments are preferable with regard to improving customizability.

Moreover, in the above embodiments, when processing images with the various image processing units, the images processed with the image processing units are printed in the order in which the image processing was finished on the roll paper by ejecting ink from the print heads belonging to the print head groups corresponding to the image processing units, but there is no limitation to this. For example, it is also possible to start the printing of the images on the roll paper P after waiting until all image processing has been terminated.

However, with the above embodiments, printing at higher speeds can be realized more effectively, using the above-described high customizability of the color ink-jet printer, so that the above embodiments are preferable with regard to this aspect.

(2) In the above embodiment, the print head groups form print head units arranged in units, and these print head units are provided with temperature sensors for detecting the temperature inside the print head units, but there is no limitation to this. For example, it is also possible to arrange the temperature sensors at another location inside the color inkjet printer.

However, the above embodiment is preferable with regard to the fact that it becomes possible to properly perform various kinds of controls in accordance with the temperature inside the print heads.

Moreover, in the present embodiment, the ejection of ink with the print heads provided in the print head units equipped with those temperature sensors is controlled with the head control units in accordance with the output from the temperature sensors, but there is no limitation to this configuration. For example, it is also possible to control other components, such as the image processing units corresponding to the print head units equipped with those temperature sensors, in accordance with the output of the temperature sensors.

However, the above embodiment is more preferable with regard to the fact that the suitable ejection of ink ensures an image formation of a high quality standard.

Moreover, in the above embodiment, the example of controlling with the head control units, in accordance with the output of the temperature sensors, the ejection of ink by the print heads included in the print head units in which those temperature sensors are provided was an example in which the ejection of the ink by the print heads provided in the print head units in which the temperature sensors are arranged is stopped if the output from the temperature sensors exceeds a predetermined value, but there is no limitation to this. For example, it is also possible to control the ink ejection amount to a constant value regardless of fluctuations in the ink viscosity due to temperature changes, by changing the driving waveform used for driving the print heads in accordance with the output from the temperature sensors.

However, the above embodiment is more preferable with regard to the fact that damage of components due to temperature rises can be properly prevented.

Moreover, in the above embodiment, the temperature sensors are arranged in the print heads, but there is no limitation to this.

However, the above embodiment is preferable with regard to the fact that the temperature of the print heads can be monitored accurately.

Moreover, in the above embodiment, the temperature sensors are arranged on a vertically upper side of the print head units, but there is no limitation to this. It is for example also possible to arrange the temperature sensors on a vertically central or lower side of the print head units.

However, the above embodiment is preferable with regard to the fact that the heat that is emitted within the print head units rises naturally in vertically upward direction, so that it becomes possible to obtain a temperature output under the worst conditions.

Moreover, those of the plurality of print heads from which the ink ejection speed is high are arranged on a vertically upper side of the color inkjet printer, and those of the plurality of print heads from which the ink ejection speed is low are arranged on a vertically lower side of the color ink-jet printer.

There are variations between individual print heads, and there are print heads with high and with low ink ejection speed. On the other hand, as mentioned above, the heat rises naturally in a vertically upward direction, so that the temperature at the vertically upper side of the color inkjet printer tends to be higher than the temperature at the vertically lower side of the inkjet printer. Moreover, the viscosity of the ink becomes lower as the temperature rises, and the ejection speed of ink with low viscosity is slower than that of ink with high viscosity.

Consequently, by arranging the print heads with high ink ejection speed on a vertically upper side of the color ink-jet printer and arranging the print heads with low ink ejection speed on a vertically lower side of the color inkjet printer, the problem that the ejection speeds of the inks that are ejected from those print heads differ from one another can be reduced.

Moreover, by combining this approach with the previous approach, that is, controlling the ejection of ink in accordance with the output of the temperature sensors, proper ink ejection is performed, and thus, it is possible to properly ensure an image formation of a high quality standard.

Moreover, the above embodiment has cleaning mechanisms for cleaning the print heads, and a cleaning mechanisms control circuit for controlling the cleaning mechanisms, and a cleaning quantity of the print heads with the cleaning mechanisms is controlled by the cleaning mechanisms control circuit, in accordance with an output of the temperature detectors, but there is no limitation to this. For example, it is also possible to control other components, such as the image processing units, in accordance with the output of the temperature sensors.

However, the above embodiment is preferable with regard to the fact that proper cleaning of the print heads in accordance with temperature changes becomes possible.

Figure 11:
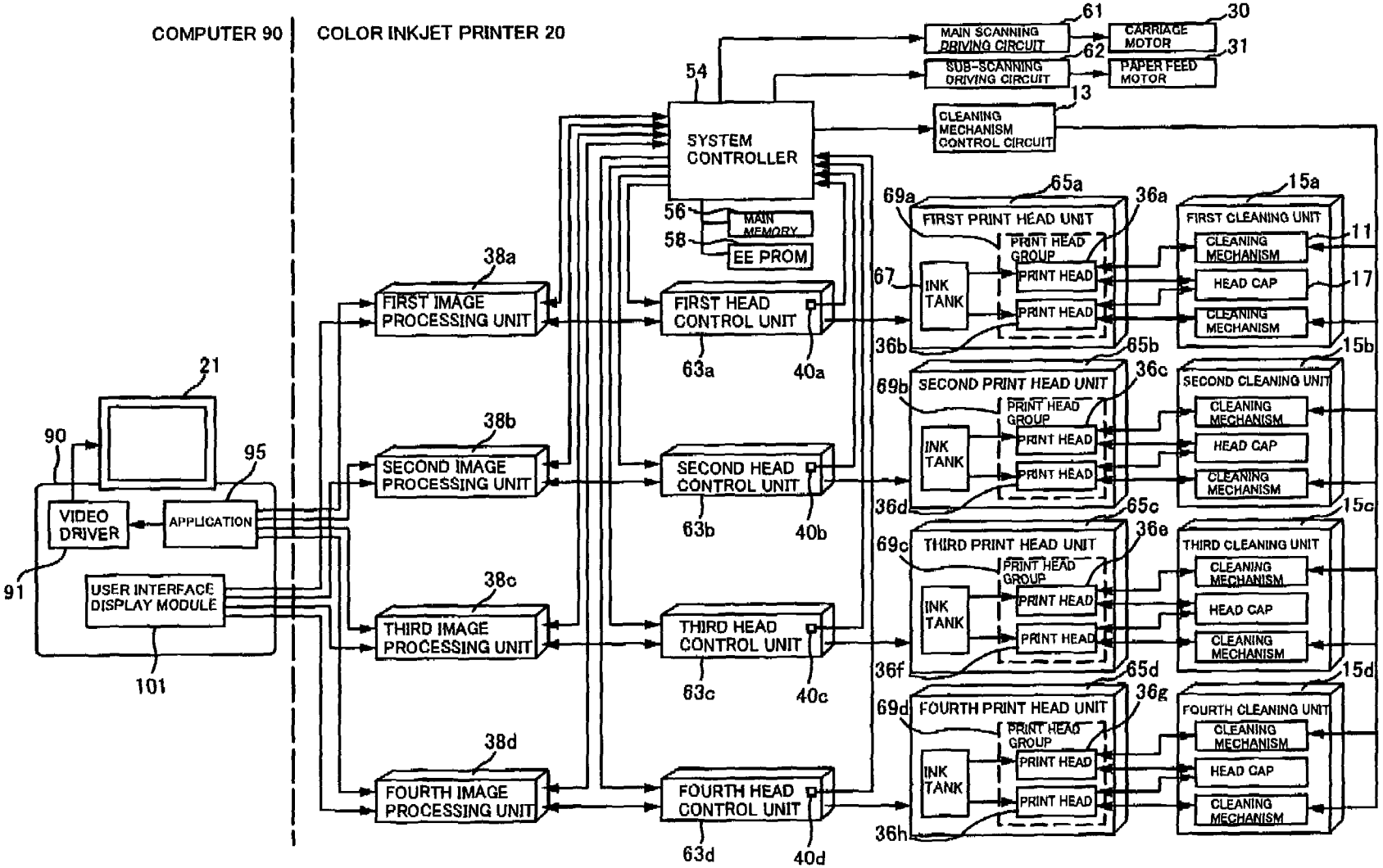
FIG. 11 is a block diagram showing the configuration of a printing system including the color inkjet printer 20.

Moreover, in the above embodiment, the temperature sensors are arranged in the print head units, but instead or in addition to this, it is also possible to arrange temperature sensors in the head control units. FIG. 11 is a block diagram showing a configuration of a printing system provided with the color inkjet printer 20, and in this block diagram, the temperature sensors are provided in the head control units instead of in the print head units.

In this case, it becomes possible to properly carry out various kinds of controls in accordance with the temperature in the head control units.

Moreover, it is also possible to control the ejection of ink with the head control units in accordance with the output from the temperature sensors.

Also in this case, the above-noted effect, that is, the effect of ensuring image formation of a high quality standard by proper ink ejection can be maintained.

Moreover, it is also possible to let the cleaning mechanism control circuits control a cleaning quantity of the print heads with the cleaning mechanism in accordance with the output from the temperature sensors.

Also in this case, the above-noted effect, that is, the effect of enabling proper cleaning of the print heads in accordance with temperature changes can be maintained.

Although preferred embodiments of the present invention have been described in detail, it should be understood that various changes, substitutions and alterations can be made therein without departing from spirit and scope of the inventions as defined by the appended claims.

What is claimed is:

1. A printing apparatus comprising:

at least two print head groups, each print head group having at least one print head for printing on a printing medium by ejecting ink, said print head being movable; and at least two image processing sections, each image processing section being provided for each of said print head groups, said image processing section being capable of processing an image to be printed on said printing medium using said print head that belongs to the print head group corresponding to that image processing section; and at least two temperature detectors, each temperature detector being provided for each of said print head groups, wherein:

said print head in which the ink ejection speed is high among all the print heads is arranged on a vertically upper side of said printing apparatus; and said print head in which the ink ejection speed is low among all the print heads is arranged on a vertically lower side of said printing apparatus.

2. A printing apparatus comprising:

at least two print head groups, each print head group having at least one print head for printing on a printing medium by ejecting ink, said print head being movable; and at least two image processing sections, each image processing section being provided for each of said print head groups, said image processing section being capable of processing an image to be printed on said printing medium using said print head that belongs to the print head group corresponding to that image processing section; and at least two temperature detectors, each temperature detector being provided for each of said print head groups;

said each of print head groups forms a print head unit arranged in a unit;

each said print head unit comprises each of said temperature detectors for detecting temperature inside that print head unit;

each of said image processing sections is arranged in a separate unit;

each of said image processing sections arranged in a unit is attachable to and detachable from the printing apparatus;

the printing apparatus further comprises at least two ink ejection control sections for controlling ejection of ink with said print heads, each of said ink ejection control sections being provided for each of said print head groups;

each of said ink ejection control sections is arranged in a separate unit;

each of said ink ejection control sections arranged in a unit is attachable to and detachable from the printing apparatus;

in accordance with an output of each said temperature detector, ejection of ink with said print head that belongs to said print head unit comprising each said temperature detector is controlled with each said ink ejection control section;

if the output from one of said temperature detectors exceeds a predetermined value, the ejection of ink with said print head that belongs to said print head unit comprising that temperature detector is stopped;

said temperature detectors are arranged in/on said print heads;

said temperature detectors are arranged on a vertically upper side of said print head units;

said print head in which the ink ejection speed is high among all the print heads is arranged on a vertically upper side of said printing apparatus, and said print head in which the ink ejection speed is low among all the print heads is arranged on a vertically lower side of said printing apparatus; and the printing apparatus further comprises cleaning sections for cleaning said print heads, and at least one cleaning control section for controlling said cleaning sections, wherein a cleaning quantity of said print heads with said cleaning sections is controlled by said cleaning control sections, in accordance with an output of said temperature detectors.

* * * * *